US010043348B2

(12) United States Patent
Meyer

(10) Patent No.: US 10,043,348 B2
(45) Date of Patent: Aug. 7, 2018

(54) SLOT MACHINE WITH BONUS TOKEN AWARDS

(71) Applicant: Ainsworth Game Technology Limited, Newington (AU)

(72) Inventor: Jason Meyer, Abbotsford (AU)

(73) Assignee: Ainsworth Game Technology Limited, Newington, NSW (AU)

( * ) Notice: Subject to any disclaimer, the term of this patent is extended or adjusted under 35 U.S.C. 154(b) by 337 days.

(21) Appl. No.: 14/724,376

(22) Filed: May 28, 2015

(65) Prior Publication Data

US 2016/0321857 A1 Nov. 3, 2016

(30) Foreign Application Priority Data

Apr. 28, 2015 (AU) ..... 2015202274

(51) Int. Cl.
*A63F 9/24* (2006.01)
*G07F 17/32* (2006.01)

(52) U.S. Cl.
CPC ..... *G07F 17/3272* (2013.01); *G07F 17/326* (2013.01); *G07F 17/3267* (2013.01)

(58) Field of Classification Search
None
See application file for complete search history.

(56) References Cited

U.S. PATENT DOCUMENTS

| | | | | |
|---|---|---|---|---|
| 6,960,134 | B2 | 11/2005 | Hartl et al. | |
| 8,360,848 | B2 | 1/2013 | Oles et al. | |
| 8,628,405 | B2 | 1/2014 | Gelber et al. | |
| 2003/0162585 | A1 * | 8/2003 | Bigelow, Jr. | G07F 17/32 463/20 |
| 2010/0120525 | A1 * | 5/2010 | Baerlocher | G07F 17/32 463/29 |
| 2016/0042597 | A1 | 2/2016 | Olive | |
| 2016/0253873 | A1 | 9/2016 | Olive | |
| 2017/0148274 | A1 | 5/2017 | Olive | |
| 2017/0154498 | A1 | 6/2017 | Olive | |

* cited by examiner

*Primary Examiner* — Lawrence Galka
(74) *Attorney, Agent, or Firm* — Cook Alex Ltd.

(57) ABSTRACT

An electronic gaming machine includes a display for displaying a first game and an electronic game controller for controlling the display of game symbols on the display. The appearance of one or more special symbols in the first game results in the award of one or more tokens to a player, the tokens being associated with at least one token value. The electronic game controller determines an accumulated token value from the token values of the tokens awarded to the player. In response to the occurrence of a trigger event, a second game is displayed, where a multiplier is applied to increase the value of any prizes awarded in the second game, the value of the multiplier being associated with the accumulated token value. A gaming method is also provided.

24 Claims, 12 Drawing Sheets

SLOT MACHINE WITH BONUS TOKEN AWARDS

BACKGROUND

The present invention relates to an electronic gaming machine and in a particular an electronic gaming machine using a base game and a feature game. The invention has been developed primarily for use as an electronic gaming machine and will be described hereinafter by reference to this application.

The following discussion of the prior art is intended to present the invention in an appropriate technical context and allow its advantages to be properly appreciated. Unless clearly indicated to the contrary, however, reference to any prior art in this specification should not be construed as an express or implied admission that such art is widely known or forms part of common general knowledge in the field.

Conventional gaming machines typically involve awarding prizes to a player according to predetermined combinations of game symbols that appear on an array of game squares displayed on a screen, typically organised into three rows and five columns (a 5×3 array). Other arrays, such as a 3×3 or 4×3, may be used. Each gaming machine randomly selects the game symbols that appear on the array, each column of the array being a "reel".

In an electronic gaming machine, the mechanical reels are replaced with video images of the reels, which are displayed on a video display screen. The electronic gaming machine has an internal electronic game controller, typically a computer, that controls the display of images on the video display screen so that the reels are visibly spun on the screen to simulate a physical reel of a traditional gaming machine. Electronic gaming machines are also more versatile in presenting game information, varying the probabilities for a player to win a prize and varying the type of game that is played.

Bonus or "feature" games may also be provided by an electronic gaming machine in addition to a base or main game. Typically feature games use the same set of reels as the main game and are limited to a set of free games operated under a single set of rules. This means that the feature game is restricted by the same set of rules, and so there is no variation in the play of the feature game.

Also, electronic gaming machines can offer one or more bonus prizes to the player during play of the game. The most common type of bonus prize that is awarded by the electronic gaming machine is a jackpot prize, the main example of which is a progressive jackpot prize.

This standard structure to game play and bonus prizes limits the variation in the play of the electronic gaming machine. Consequently, it is difficult to retain player interest because there is no apparent incentive for the player to continue playing the same electronic gaming machine once the player becomes familiar with the feature game, the main game and any bonus prizes. Also, it is difficult to retain player interest since there is little differentiation between gaming machines in terms of the main and feature games that are played.

It is an object of the present invention to overcome or substantially ameliorate one or more of the disadvantages of prior art, or at least to provide a useful alternative.

SUMMARY

According to a first aspect of the invention, there is provided an electronic gaming machine comprising:

a display for displaying game symbols for playing a first game, said first game comprising displaying randomly selected game symbols, wherein the display of predetermined winning combinations of said game symbols results in the award of prizes to a player; and an electronic game controller for controlling the display of said game symbols on said display;

wherein said first game comprises the appearance of one or more special symbols that results in the award of one or more tokens to said player, said tokens being associated with at least one token value;

wherein said electronic game controller determines an accumulated token value from the token values of the tokens awarded to said player;

wherein, in response to a trigger event, said electronic game controller causes said display to display game symbols for playing a second game, said second game comprising displaying randomly selected game symbols and awarding prizes to said player upon the display of predetermined winning combinations of game symbols; and wherein a multiplier is applied to increase the value of any prizes awarded in said second game, the value of said multiplier being associated with said accumulated token value.

Preferably, said multiplier varies from an initial multiplier value up to a maximum multiplier value between two or more plays of said second game. More preferably, said multiplier incrementally increases by one from said initial multiplier value up to said maximum multiplier value. Alternatively, said multiplier increases by stepwise amounts from said initial multiplier value up to said maximum multiplier value. In some embodiments, said multiplier changes in value after a predetermined number of plays of said second game. In one embodiment, said predetermined number of plays of said second game is one. In an alternative embodiment, said predetermined number of plays of said second game is three.

Preferably, said maximum multiplier value is associated with said accumulated token value. More preferably, said maximum multiplier value increases with an increase in said accumulated token value. It is further preferred that said maximum multiplier value is limited to a capped value. In one embodiment, said capped value is 8.

Preferably, said initial multiplier value is two.

Preferably, said multiplier is shown in real time on said display during play of said second game.

Preferably, an in-game message is displayed on said display advising said multiplier in effect during said second game.

Preferably, said trigger event comprises said accumulated token value being equal to or in excess of a predetermined number. Alternatively, said trigger event preferably comprises an in-game trigger event in said first game. In a further alternative, said trigger event preferably comprises an internally generated trigger event randomly determined by said electronic game controller. More preferably, said electronic game controller determines whether said trigger event has occurred at the end of said first game.

Preferably, said second game comprises an enhanced or improved version of said first game.

Preferably, said tokens awarded to said player are shown on said display. More preferably, said awarded tokens are displayed in a meter in real time on said display.

Preferably, said token values associated with said awarded tokens are shown on said display. More preferably, said token values associated with said awarded tokens are displayed in a meter in real time on said display.

Preferably, said accumulated token value is shown on said display. More preferably, said accumulated token value is displayed in a meter in real time on said display.

Preferably, said predetermined number is at least 1.

Preferably, said tokens comprise at least one of a symbol or numerical value.

Preferably, said player is awarded free plays of said first game and must make a bet to play said second game.

Preferably, a retrigger event in said first game causes said electronic game controller to award additional plays of said first game.

Preferably, said first game comprises a feature game, and said electronic gaming machine provides a base game wherein, in response to a feature game trigger event in said base game, said electronic game controller causes said display to display game symbols for playing said feature game. Alternatively, said electronic game controller causes the display of said feature game and said base game during play of said base game, said feature game being inactive until triggered. In this embodiment, the change in said feature game from being inactive to active may be indicated on the display. This indication may be visual, aural or a combination of both.

Preferably, said first game comprises a base game.

Preferably, the appearance of said special symbol in a designated symbol position in a play of said first game results in said special symbol reappearing in said designated symbol position for subsequent plays of said first game and said second game.

Preferably, the appearance of said special symbol in a designated symbol position in a play of said second game results in said special symbol reappearing in said designated symbol position for subsequent plays of said second game.

Preferably, said multiplier is not associated with any of said game symbols in said first game.

Preferably, said multiplier is not associated with any of said game symbols in said second game.

Preferably, said first game comprises an array of predetermined symbol positions. More preferably, said first game comprises randomly displaying game symbols in said array.

Preferably, said second game comprises an array of predetermined symbol positions. More preferably, said second game comprises randomly displaying game symbols in said array.

Preferably, said array has rectangular, circular, triangular, oval, semi-circular or other non-rectangular shape.

Preferably, said array comprises one or more rows and/or columns of said symbol positions. In one embodiment, said array comprises a plurality of reels. Preferably, the player selectively starts and/or stops play of said reels in said game array and/or said reels in said feature game.

Preferably, said game symbols in said first game and said second game are displayed in arrays of the same shape or type. Alternatively, said game symbols in said first game and said second game are displayed in differently shaped arrays.

Preferably, said electronic gaming machine comprises a housing having said display and containing said electronic game controller.

Preferably, said electronic gaming machine comprises an input device. It is also preferred that said input device comprises one or more buttons on said housing, said buttons being in electronic communication with said electronic game controller to transmit player commands to said electronic game controller. More preferably, said buttons are arranged on a console of said housing. Alternatively or additionally, said input device comprises a touch sensitive surface on said display for receiving player commands, said touch sensitive surface being in electronic communication with said electronic game controller to transmit player commands to said electronic game controller.

Preferably, said electronic gaming machine comprises a value transfer mechanism for paying said prizes to said player using value in an amount equal to an awarded prize. Alternatively or additionally, said value transfer mechanism receives value from said player to make said bet and initiate play of a game on said electronic gaming machine. The game comprises the first game and/or the second game. More preferably, said value transfer mechanism is in electronic communication with said electronic game controller. It is also preferred that said value transfer mechanism is provided on said housing. In one embodiment, said value transfer mechanism comprises one or more vending slots for paying and/or receiving value. In other embodiments, said value transfer mechanism comprises a value input/value output device. In further embodiments, said value transfer mechanism comprises a coin slot or acceptor, a paper currency acceptor, a ticket reader and/or printer or a card reader and/or writer.

Throughout the specification and unless explicitly stated otherwise, the term "value" means money denominations, credits, gaming tokens, coins, paper, currency, tickets, vouchers (both physical and electronic), credit cards, debit cards, smart cards, memory devices capable of storing value and any other object representative of value.

Preferably, the electronic gaming machine comprises a mobile electronic gaming device. More preferably, said mobile electronic gaming device comprises a handheld electronic device. Alternatively, said electronic gaming machine comprises a computer. More preferably, said computer is connected to a communication network.

A second aspect of the present invention provides an electronic gaming machine comprising:

a display for displaying game symbols for playing a first game, said first game comprising randomly displaying randomly selected game symbols, wherein the display of predetermined winning combinations of said game symbols results in the award of prizes to a player;

an electronic game controller in electronic communication with said display for controlling the appearance of game symbols in said first game on the display; and a value transfer mechanism for receiving value from a player to make a bet and initiate play of said first game on said display, said value transfer mechanism being in electronic communication with said electronic game controller;

wherein said electronic game controller in response to said player making a bet via said value transfer mechanism commences play of said first game by randomly selecting game symbols and transmitting a signal to said display to display said randomly selected game symbols;

wherein said first game comprises the appearance of one or more special symbols that results in the award of one or more tokens to said player, said tokens being associated with at least one token value;

wherein said electronic game controller determines an accumulated token value from the token values of the tokens awarded to said player;

wherein, in response to a trigger event, said electronic game controller transmits a signal to said display to display game symbols for playing a second game, said second game comprising displaying randomly selected game symbols and awarding prizes to said player upon the display of predetermined winning combinations of game symbols; and wherein said electronic game controller applies a multiplier to increase the value of any prizes awarded in said second game, the value of said multiplier being associated with said accumulated token value.

This second aspect of the invention preferably has the preferred features of the first aspect of the invention stated above, where applicable.

According to a third aspect of the invention, there is provided a gaming method for an electronic gaming machine comprising a display and an electronic game controller, the method comprising the steps of:

controllably displaying game symbols for playing a first game, said first game comprising displaying randomly selected game symbols, wherein the display of predetermined winning combinations of said game symbols results in the award of prizes to a player;

awarding one or more tokens to said player in response to the appearance of one or more special symbols;

determining an accumulated token value from the token values of the tokens awarded to said player;

causing the display of game symbols playing a second game in response to a trigger event, said second game comprising displaying randomly selected game symbols and awarding prizes to said player upon the display of predetermined winning combinations of game symbols;

associating a multiplier with said accumulated token value; and applying multiplier to increase the value of any prizes awarded in said second game.

Preferably, said method comprises varying said multiplier from an initial multiplier value up to a maximum multiplier value between two or more plays of said second game. More preferably, said method comprises incrementally increasing said multiplier by one from said initial multiplier value up to said maximum multiplier value. Alternatively, said method comprises increasing said multiplier by stepwise amounts from said initial multiplier value up to said maximum multiplier value. In some embodiments, said method comprises changing said multiplier in value after a predetermined number of plays of said second game. In one embodiment, said method comprises providing one as the predetermined number of plays of said second game. In an alternative embodiment, said method comprises providing three as said predetermined number of plays of said second game.

Preferably, said method comprises associating said maximum multiplier value with said accumulated token value. More preferably, said method comprises increasing said maximum multiplier value with an increase in said accumulated token value. The method further preferably comprises limiting said maximum multiplier value a capped value. In one embodiment, said method comprises limiting said maximum multiplier value to a capped value of 8.

Preferably, said method comprises setting said initial multiplier value to two.

Preferably, said method comprises showing said multiplier in real time on said display during play of said second game.

Preferably, said method comprises displaying an in-game message on said display to indicate said multiplier in effect during said second game.

Preferably, said method comprises providing said accumulated token value being equal to or in excess of a predetermined number as said trigger event. Alternatively, said method preferably comprises providing an in-game trigger event in said first game as said trigger event. In a further alternative, said method preferably provides an internally generated trigger event randomly determined by said electronic game controller as said trigger event.

Preferably, said method comprises determining whether said trigger event has occurred at the end of said first game.

Preferably, said method comprises providing said second game as an enhanced or improved version of said first game.

Preferably, said method comprises showing said tokens awarded to said player on said display. More preferably, said method comprises displaying said awarded tokens in a meter in real time on said display.

Preferably, said method comprises showing said token values associated with said awarded tokens on said display. More preferably, said method comprises displaying said token values associated with said awarded tokens in a meter in real time on said display.

Preferably, said method comprises showing said accumulated token value on said display. More preferably, said method comprises displaying said accumulated token value in a meter in real time on said display.

Preferably, said tokens comprise at least one of a symbol or numerical value.

Preferably, said method comprises awarding said player free plays of said first game and requiring said player to make a bet to play said second game.

Preferably, said method comprises providing a retrigger event in said first game that causes said electronic game controller to award additional plays of said first game.

Preferably, said method comprises providing a designated symbol position in said first game and, where said special symbol appears in said designated symbol position in a play of said first game, causing said special symbol to reappear in said designated symbol position for subsequent plays of said first game and said second game.

Preferably, said method comprises providing a designated symbol position in said second game and, where said special symbol appears in said designated symbol position in a play of said second game, causing said special symbol to reappear in said designated symbol position for subsequent plays of said second game.

Preferably, said method comprises not associating said multiplier with any of said game symbols in said first game.

Preferably, said method comprises not associating said multiplier with any of said game symbols in said second game.

Preferably, said method comprises providing an array of predetermined symbol positions in said first game. More preferably, said method comprises randomly displaying game symbols in said symbol positions of said array in said first game.

Preferably, said method comprises providing an array of predetermined symbol positions in said second game. More preferably, said method comprises randomly displaying game symbols in said symbol positions of said array in said second game.

Preferably, said method comprises displaying said array in a rectangular, circular, triangular, oval, semi-circular or other non-rectangular shape.

Preferably, said method comprises providing said first game as a base game.

Preferably, said method comprises providing said first game as a feature game and providing a base game wherein, in response to a feature game trigger event in said base game, said electronic game controller causes said display to display game symbols for playing said feature game. Alternatively, said method comprises said electronic game controller causing the display of said feature game and said base game during play of said base game, said feature game being inactive until triggered. In this embodiment, said method comprises indicating on the display the change in said feature game from being inactive to active. Preferably, the indicating step may be visual, aural or a combination of both.

Preferably, said method comprising displaying said game symbols in said first game and said second game in arrays of the same shape or type. Alternatively, said method comprises displaying said game symbols in said first game and said second game in differently shaped arrays.

Preferably, said method comprises arranging said array into one or more rows and/or columns of said symbol positions. In one embodiment, said method comprises arranging said array into a plurality of reels. Preferably, said method comprises enabling said player to selectively start and/or stop play of said reels in said array.

The method preferably has the preferred features of the first aspect of the invention where applicable.

A fourth aspect of the present invention provides a gaming method for an electronic gaming machine comprising a display for displaying a first game, wherein said first game comprises displaying randomly selected game symbols, wherein the display of predetermined winning combinations of said game symbols results in the award of prizes to a player; an electronic game controller for controlling the display of said game symbols for playing said first game on said display; and a value transfer mechanism for receiving value from a player to make a bet and initiate play of said first game on said display, said value transfer mechanism being in electronic communication with said electronic game controller, the method comprising:

said electronic gaming machine receiving a bet from said player via said value transfer mechanism to initiate play of said first game on said display;

said electronic game controller controllably displaying game symbols for playing said first game;

said electronic game controller awarding one or more tokens to said player in response to the appearance of one or more special symbols;

said electronic game controller determining an accumulated token value from the token said electronic game controller values of the tokens awarded to said player;

causing the display of game symbols playing a second game in response to a trigger event, said second game comprising displaying randomly selected game symbols and awarding prizes to said player upon the display of predetermined winning combinations of game symbols;

said electronic game controller associating a multiplier with said accumulated token value; and said electronic game controller applying multiplier to increase the value of any prizes awarded in said second game.

The method of the fourth aspect of the invention preferably has the preferred features of the third aspect of the invention stated above, where applicable.

According to a fifth aspect of the invention, there is provided a computer system comprising a central processing unit configured for communication with an electronic gaming machine, wherein said computer system is configured to perform the method of the third or fourth aspects of the invention.

According to a sixth aspect of the invention, there is provided a computer programme configured to perform the method of the third or fourth aspects of the invention.

According to a seventh aspect of the invention, there is provided a non-transitory carrier medium carrying computer executable code that, when executed on a central processing unit configured for communication with an electronic gaming machine, causes the central processing unit to perform the method of the third or fourth aspects of the invention.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Furthermore, as used herein and unless otherwise specified, the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

BRIEF DESCRIPTION OF THE DRAWINGS

Preferred embodiments of the invention will now be described, by way of example only, with reference to the accompanying drawings in which.

DETAILED DESCRIPTION OF VARIOUS EMBODIMENTS

Figure 1:
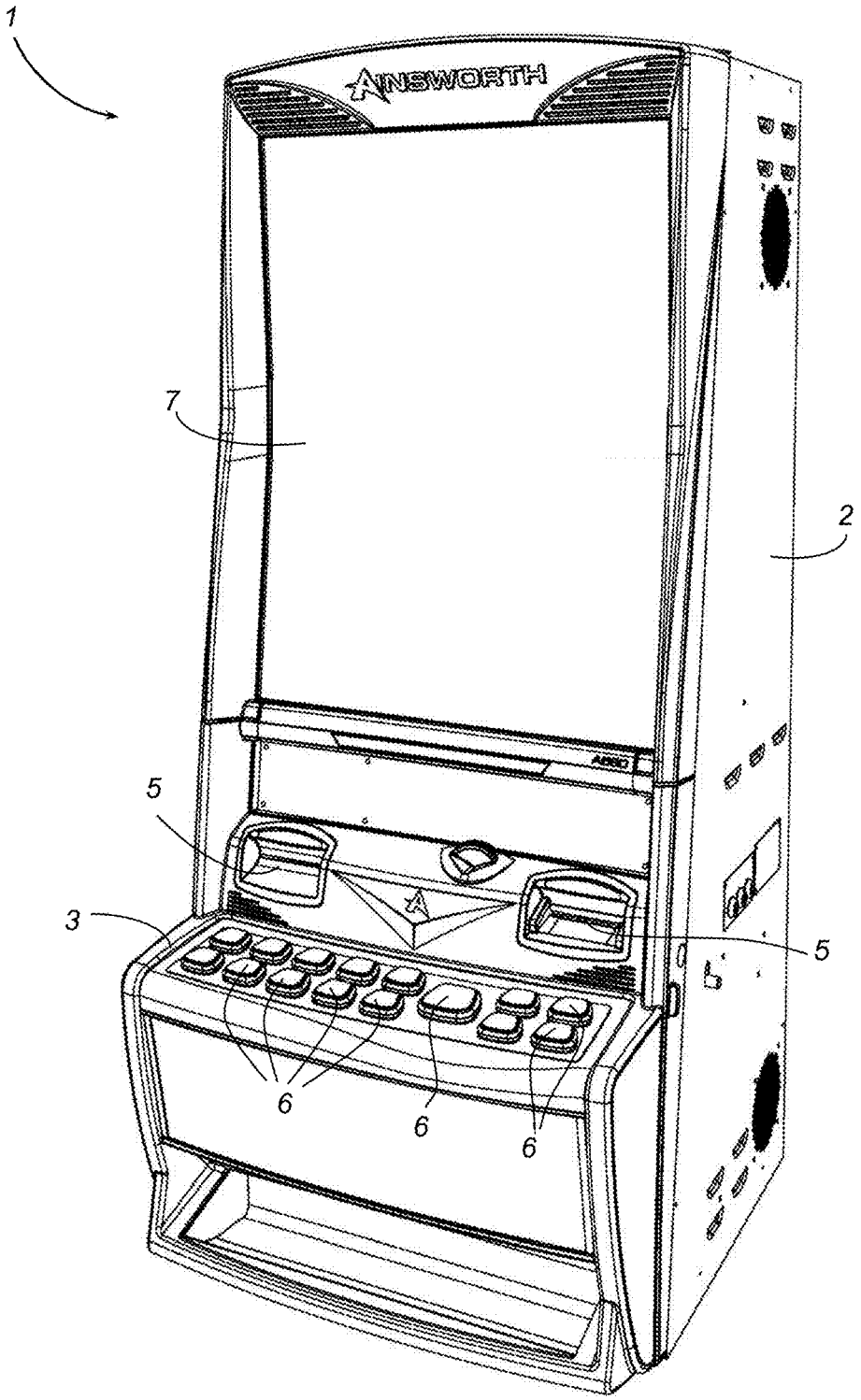
FIG. 1 is a perspective view of an electronic gaming machine according to an embodiment of the invention.

The present invention will now be described with reference to the following examples which should be considered in all respects as illustrative and non-restrictive. In the Figures, corresponding features within the same embodiment or common to different embodiments have been given the same reference numerals.

Referring to FIG. 1, an electronic gaming machine 1 according to a first embodiment of the invention includes a cabinet 2, a console 3 and an internal electronic game controller 4. The console 3 has various input devices including vending slots 5 for receiving monetary bets and a plurality of buttons 6 for actuation by a player. It will be appreciated that in other embodiments the vending slots 5 may be replaced with other types of value input/value output devices, such as a coin acceptor, a paper currency acceptor, a ticket reader and/or printer or a card reader and/or writer.

The vending slots 5 can be configured to receive value, such as cash in the form of banknotes and coins, or credits representing a monetary amount from a memory device, such as but not limited to a memory card, smart card, a radio frequency identification (RFID) device, USB key, magnetic card or other electronic storage device. Typically, the memory device is a credit card, debit card or other card that enables the transfer of monetary credit to the electronic gaming machine 1. Other forms of value include gaming tokens, paper, tickets, vouchers, and any other object representative of value.

Figure 2:
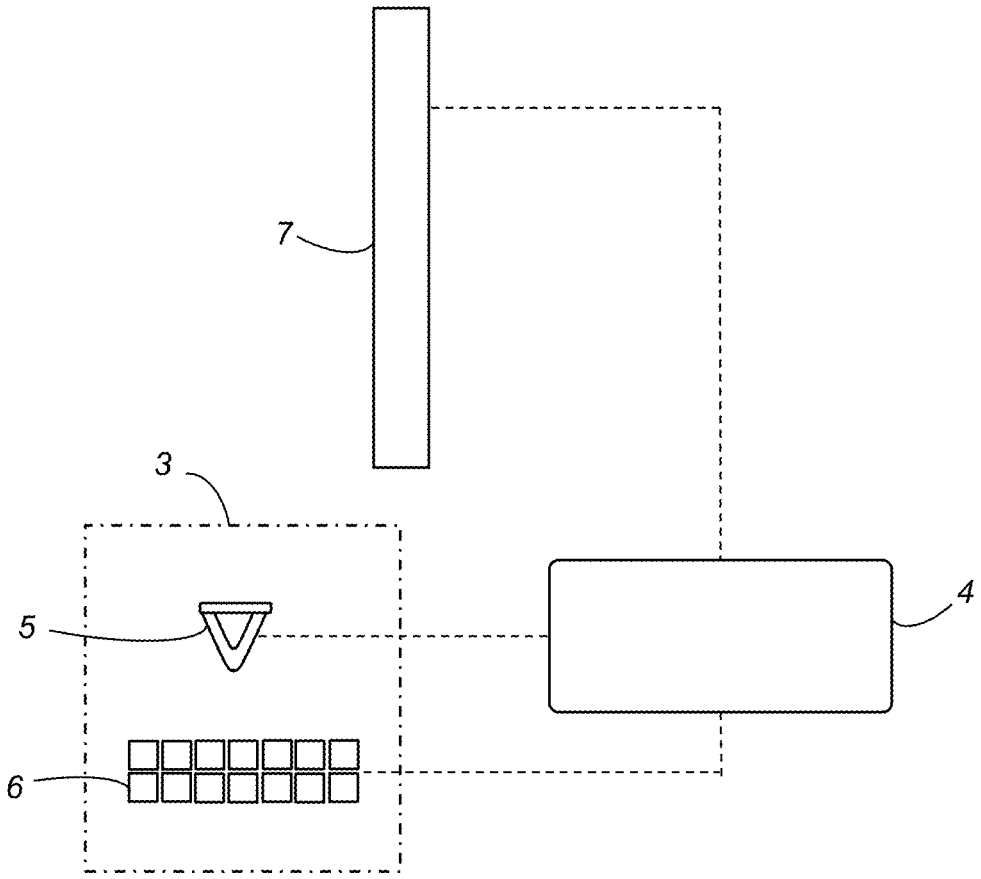
FIG. 2 is a schematic drawing of an electronic game controller for the electronic gaming machine of FIG. 1.

The electronic game controller 4 is generally in the form of a central processing unit, such as a computer, and is in electronic communication with a display in the form of a video display screen 7, as well as various input devices on the console 3, as best shown in FIG. 2. Typically, the electronic game controller 4 also comprises a random access memory (RAM) associated with the central processing unit, the RAM being used to store programme instructions and transient data related to the operation of the electronic game controller and hence the electronic gaming machine 1. The RAM contains a body of program instructions for implementing a game on the electronic gaming machine 1, as discussed in more detail below. The central processing unit or processor may also be operatively associated with a further storage device, such as a hard disk drive, which is used for long-term storage of program components and data relating to the electronic game controller 4 and/or the electronic gaming machine 1, including a database for game performance data, as well as information gathered from users. It is also appreciated that a person skilled in the art would readily understand the location and use of the electronic game controller 4 in the electronic gaming machine 1.

The electronic game controller 4 will transmit and receive signals to and from each of the input devices and the display 7, usually via wired connections but can include wireless modes of electronic communication, such as WLAN. In the case of the vending slots 5 (or with any other type of value transfer mechanism), there may be an intermediate credit verification device that examines and verifies the cash or credits received by the vending slots. Once the value (such as cash or credits) have been verified by the credit verification device, a signal is sent to the electronic game controller 4, which then determines whether the minimum bet level has been reached. If so, the electronic game controller 4 will permits play of the game on the electronic gaming machine 1. If not, the electronic game controller 4 will send a signal to the display 7 to show a message requesting further value to be added to the electronic gaming machine 1.

Figure 3:
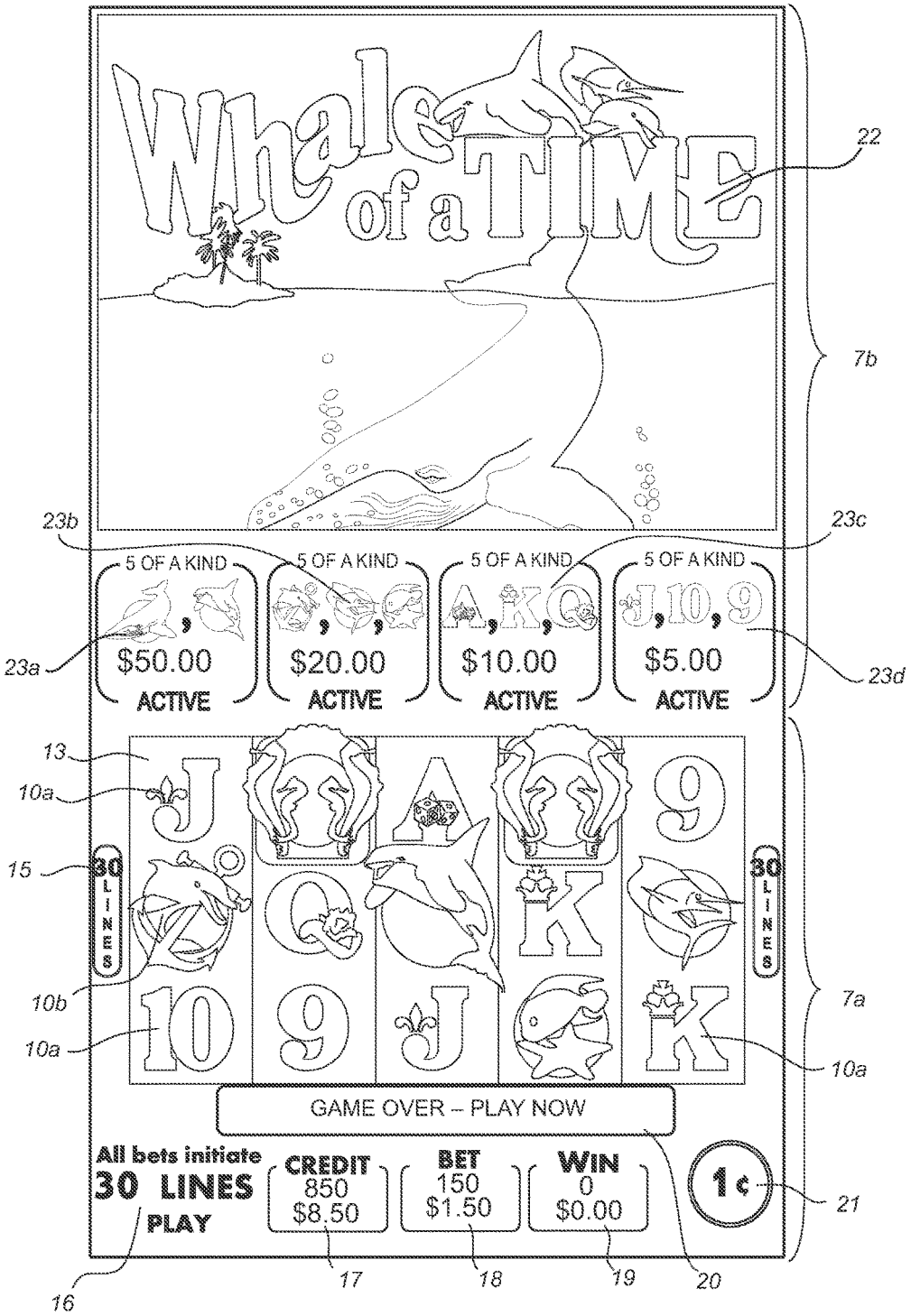
FIG. 3 is a simulated screen shot illustrating a base game played on the electronic gaming machine of FIG. 1.
Figure 5:
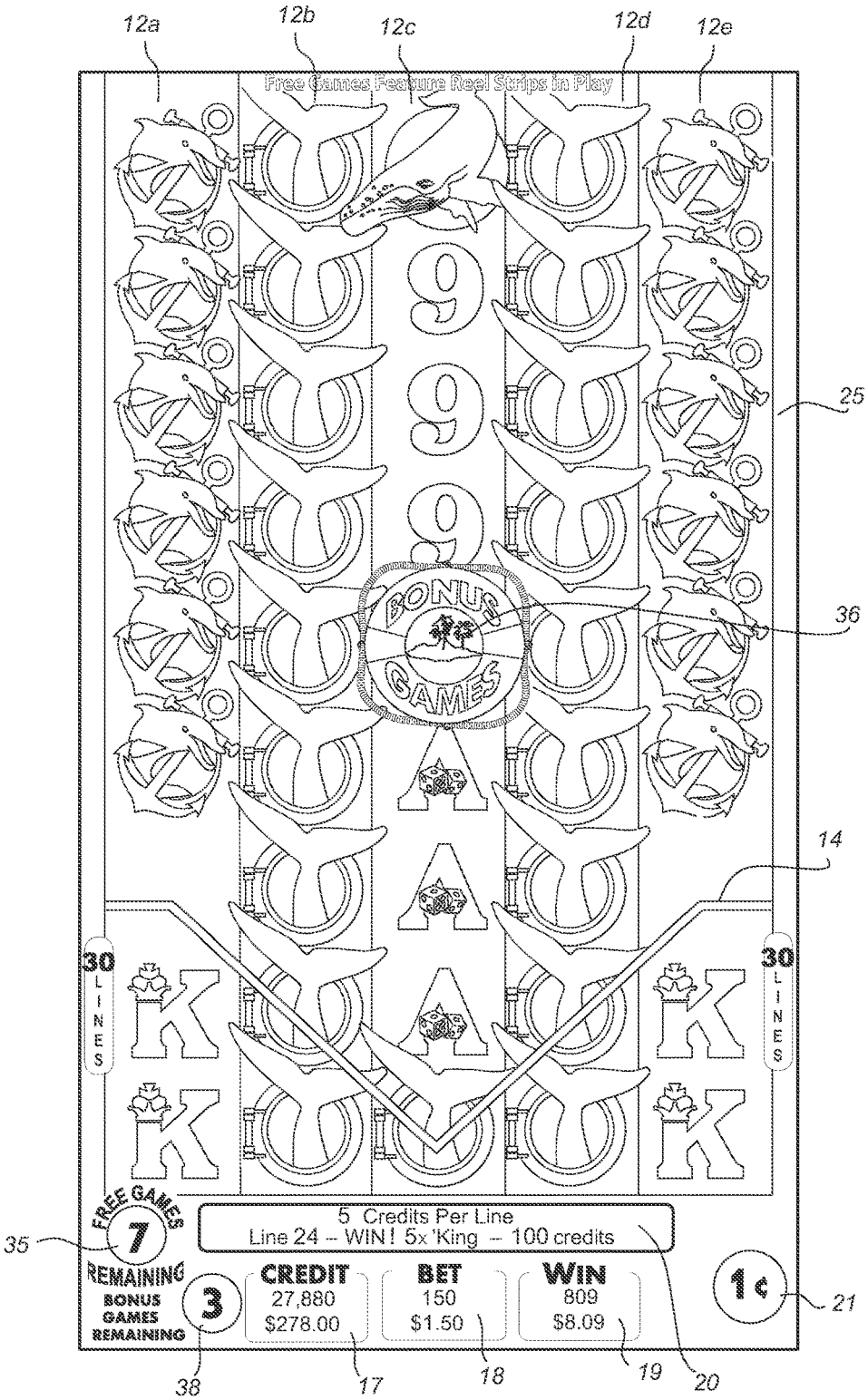

The electronic game controller 4 is programmed to provide a game in the form of a base game 8 (as best shown in FIG. 3) and a feature game 9 (as best shown in FIG. 5) on a lower display area 7*a* of the display 7 of the electronic gaming machine 1 for play by a player. The base game 8 has game symbols 10 arranged into an array 11 in the form of five columns or "reels" 12*a*, 12*b*, 12*c*, 12*d* and 12*e*. The reels 12*a*, 12*b*, 12*c*, 12*d* and 12*e* give the visual appearance of rotating, typically by having the game symbols 10 move in a downward linear path along the length of each reel 12*a*, 12*b*, 12*c*, 12*d* and 12*e*. The array 11 is arranged with five reels 12*a*, 12*b*, 12*c*, 12*d* and 12*e* and three rows as per the industry standard, it will be appreciated by one skilled in the art that other types of arrays could be used, such as 3×3, 4×3, 5×5, 4×4, etc, including arrays having an irregular number of rows and/or columns. For example, the array 11 can have an unequal number of rows and/or columns, where some columns have less or more rows than other columns or where some rows have less or more columns than other rows. A more specific example would be an array having three columns with only two rows and two columns with three rows. The electronic game controller 4 will transmit signals to the display screen 7 to cause the base game 8 and feature game 9 to be played on the lower display area 7*a*, including showing the game symbols 10, array 11 and other visible elements of the games.

The array 11 of the base game 8 defines predetermined symbol positions 13, in which the game symbols 10 appear. In this embodiment, the symbol positions 13 are not defined by any visible boundary lines and simply provide an area for the game symbols 10 to appear. However, it will be appreciated that in other embodiments, the symbol positions 13 are visually marked by boundary lines to define "squares" or "cells". In yet other embodiments, other markings can be used to define each respective area of the symbol positions 13 or game positions.

The array 11 is arranged so that a player can select one or more predetermined "pay lines" 14 defined around the array, which correspond to combinations of the symbol or game positions 13. The pay lines 14 correspond to the lines selected by the player and generally comprise at least one game position or symbol position 13 from each reel 12. The number of pay lines 14 that can be selected by the player depends on the amount of the monetary bet for playing a game on the array 11. In the base game 8, predetermined winning combinations of randomly selected game symbols 10 result in the award of prizes to the player.

The game symbols 10 can include a mixture of picture symbols (such as animal symbols or playing card symbols), word symbols, scatter symbols, substitute or wild card symbols and trigger symbols. Those skilled in the art will readily understand that a substitute symbol is able to act as any other game symbol, and hence is also known as a "wild card" symbol. Likewise, those skilled in the art will readily understand that a scatter symbol is a symbol that triggers a game event or confers an award without having to appear on a player-selected pay line 14. Similarly, a trigger symbol is a symbol that triggers a game event (like activating a feature game) or confers an award, where the trigger symbol may or may not have to appear in combination and may or may not have to appear on the same player-selected pay line 14. In this embodiment, the game symbols 10 include playing card symbols 10*a*, picture symbols 10*b* and a substitute or wild card symbol in the form of a "Whale of a Time" symbol 10*c*, which will be referred hereinafter as the Whale symbol 10*c*. In this embodiment, the Whale symbol 10*c* also acts as a scatter symbol that triggers the feature game 9. The electronic game controller 4 randomly determines the appearance of the game symbols 10 on the array 11.

The lower display area 7*a* also displays other standard game information including the number of pay lines 15, a message area 16 indicating that the number of pay lines (being 30 pay lines) is constant for any bet made by the player, the amount of player credits 17, the amount of the current bet wagered by the player 18, the amount of wins by the player 19, a message area 20 and a current denomination button 21 indicating the currently selected base bet denomination. Other standard information may also include a menu button (not shown) for bringing up a menu screen (not shown). In other embodiments, the player is able to select subset of the number of pay lines 14, so the lower display area 7*a* will show or indicate the number of pay lines available and the number of player-selected pay lines.

An upper display area 7*b* of the video screen 7 may display an animated title (in this case, the name of the game 22 "Whale of a Time"™) or feature screen for the game and/or information relating to the rules for the base game 8 and feature game 9 discussed below. This includes information outlining the key characteristics of the base game 8 and feature game 9. The upper display area 7*b* also displays jackpot information relating to the base game 8 and/or feature game 9 that are awarded by the electronic gaming machine 1. This jackpot information can comprise, in descending order of monetary value, a grand jackpot, major jackpot, minor jackpot and midi jackpot. In this embodiment, four jackpots are available, as indicated by message boxes 23*a* to 23*d*, which will be discussed in more detail below.

The player initially makes a bet using vending slots 5 initiate play of the electronic gaming machine 1 to build up credit to play the base game 8 on the electronic gaming machine. For example, the player can bet or wager monetary amounts equivalent to a particular amount of credits, depending on the bet denomination selected for the base game. Also, the player can make any additional side bets or ante-bets during play of the base game once the game has commenced to access additional features in the game, such as increasing the number of winning combinations in the game.

Typically, electronic gaming machines offer a number of preset bet options that the player can make, and these bet options can vary depending on the game or games offered on the electronic gaming machine. For example, a game on an electronic gaming machine may provide bet options of 1 credit, 2 credits, 5 credits and 10 credits per player-selected pay line 14. In another example, the player may bet 1 credit, 2 credits, 5 credits and 10 credits for a preset group or combination of pay lines 14, such as a group of 5 pay lines, 10 pay lines, 20 pay lines, etc.

Usually, the bet option selected determines the number of pay lines 14 that become payable in the base game 8. However, in this embodiment, the selected bet option determines which jackpots become available in the base game 8, and these a jackpots are tied to a particular combination, being five of a kind of the same game symbol for certain game symbols 10. For example, a base bet of 1 credit will only permit a midi jackpot to be available where there is a winning five of a kind combination of 9, 10 or J playing card symbols in a player-selected pay line 14, as indicated by message box 23*d* shown in FIG. 3. A bet of 2 credits will permit the midi jackpot to be available as described, as well as a minor jackpot where there is a winning five of a kind combination of A, K or Q playing card symbols in a player-selected pay line 14, as indicated by message box 23*c* shown in FIG. 3. A bet of 5 credits will permit the midi and minor jackpots to be available as described above, as well as a major jackpot where there is a winning five of a kind combination of three of the picture symbols 10*b* in a player-selected pay line 14, as indicated by message box 23*b* shown in FIG. 3. Finally, all the jackpots will become available upon a maximum bet of 10 credits, including the midi, minor and major jackpots described above, and the grand jackpot where there is a winning five of a kind combination of two of the picture symbols 10*b* in a player-selected pay line 14, as indicated by message box 23*a* shown in FIG. 3.

Typically, the electronic gaming machine also has a default bet denomination, which is usually the bet denomination that was previously used in the preceding play of the base game 8. For example, if a person had played the base game 8 with a bet denomination of 5¢, then this would be the default bet denomination for the player when he or she commences play of the game. Where the electronic gaming machine has not yet been played or has been started up, the default bet denomination is initially selected by the electronic game controller 4. The default bet denomination can be randomly selected or chosen according to a predetermined order. Typically, the electronic game controller 4 will select the bet denomination with the lowest value that is available for the base game 8, which would be the 1¢ bet denomination for this embodiment. The player may change the bet denomination at any time in the base game 8 by touching the denomination button before or after the reels 12 have spun. In this embodiment, touching the denomination button 21 will bring denomination images that the player may select to quickly change the bet denomination between plays of the game 8.

Once the player has made a bet to commence play of the game 8, the electronic game controller 4 then transmits a signal to the display 7 to make reels 12 to appear to visibly rotate or "spin" in a linear path, typically in a downward vertical direction, and randomly display the game symbols 10 in each symbol position 13 for each play of the array 11 for the base game 8. After the reels 12 stop spinning, the electronic game controller 4 determines whether there are any predetermined winning combinations of the game symbols 10 appearing in any player-selected pay lines 14, such as a two of a kind, three of a kind, four of a kind or five of a kind for all the game symbols 10. Where playing card symbols are optionally used, other predetermined winning combinations include poker-based combinations of a "full house", "straight" or "flush". It will be appreciated that other winning combinations of game symbols 10 can also be provided. If so, the electronic gaming machine 1 enters a winning game state and awards a prize according to the displayed predetermined winning combination.

Figure 4:
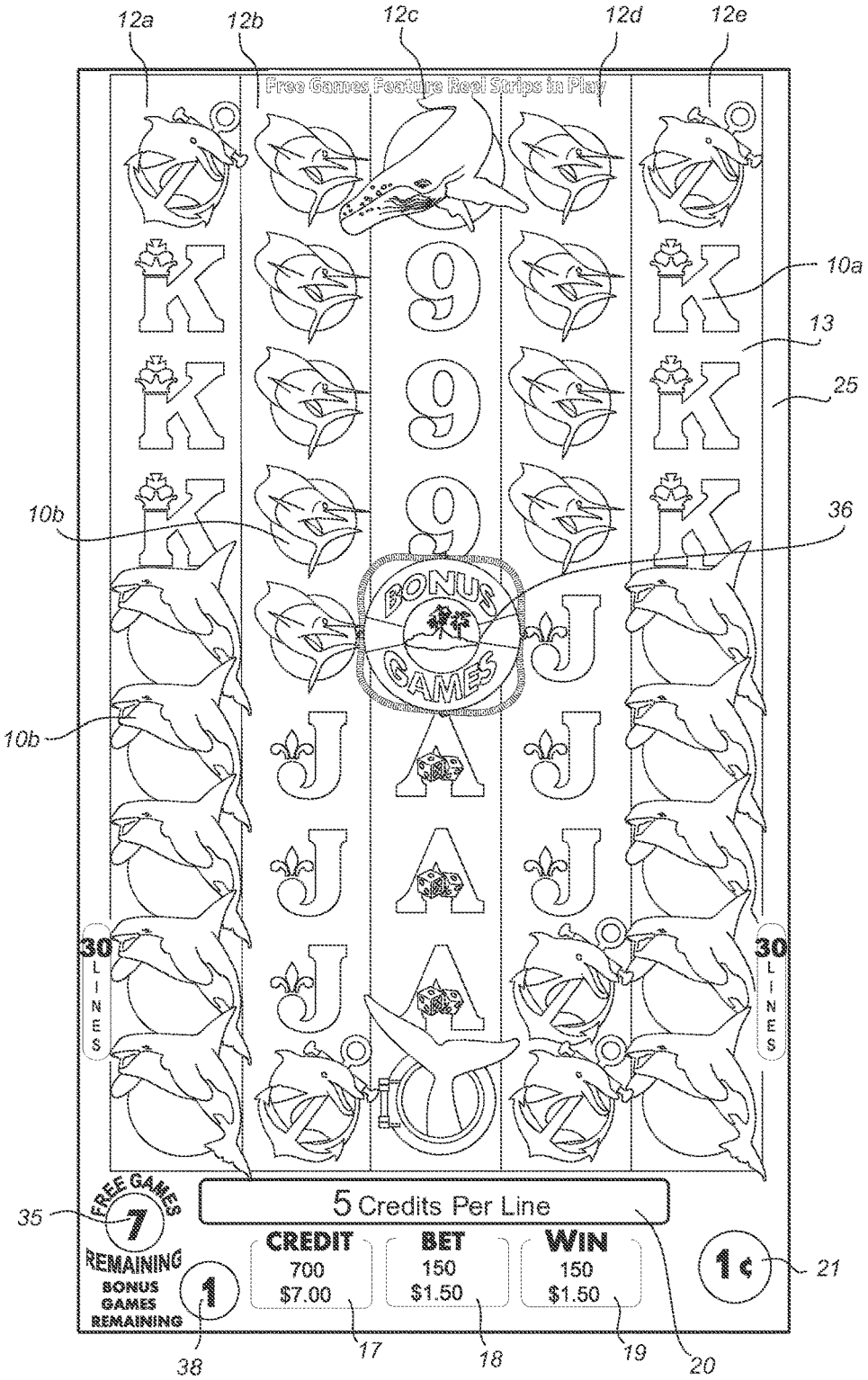
FIGS. 4 and 5 are simulated screen shots illustrating a feature game played on the display of the electronic gaming machine of FIG. 1.

In addition, the electronic game controller 4 randomly determines whether a predetermined trigger event has occurred which triggers the feature game 9 on the electronic gaming machine 1. In this embodiment, the trigger event is the appearance of three Whale symbols 10*c* anywhere on the reels 12 without having to be on a player-selected pay line 14; i.e. the Whale symbols 10*c* act as scatter symbols in this instance. In response to this trigger event, the electronic game controller 4 then causes the feature game 9 to be shown on the lower display area 7*a* and upper display area 7*b* of the screen 7, as best shown in FIG. 4. However, it will be appreciated that in other embodiments, the feature game 9 can be shown in only a part of the screen 7, such as the lower display area 7*a* or the upper display area 7*b*.

The feature game 9 uses an array 25 that uses the same game symbols 10, reels 12*a* to 12*e*, symbol positions 13 and pay lines 14 from the base game 8. However, the feature game array 25 has triple the amount of symbol positions 13, each reel 12 having three times as many symbol positions 13; i.e. nine symbol positions per reel 12 instead of three symbol positions. This means that additional pay lines are provided using the additional symbol positions 13 in the reels 12*a* to 12*e*. Since the same winning combinations of game symbols 10 from the base game 8 will award the same or enhanced prizes to the player in the feature game 9, the player has a greater opportunity in obtaining a winning combination of game symbols 10 and thus winning a prize from the electronic gaming machine 1.

In the feature game 9, ten free plays or spins of the reels 12 are awarded to the player. It will be understood by those skilled in the art that a free spin involves a play of the game without requiring any bet to be made by the player, and that any number of free spins can be chosen for the feature game. In addition, it will be appreciated that in the art free spins are commonly referred to as "free games". The number of free spins left in the feature game 9 is indicated in a counter 35. In FIG. 4, the third free spin has concluded and the counter 35 shows that seven free spins remain in the feature game 9.

The electronic game controller 4 also assesses whether a special symbol in the form of a "bonus games" symbol 36 appears in a symbol position 13 on the reels 12*a* to 12*e*. In FIG. 4, the bonus games symbol 36 has appeared and this acts as a trigger event for the feature game 9 to award a token to the player. In this embodiment, the token comprises a bonus game token and a bonus game token counter or meter 38 shows the number of accumulated bonus game tokens that the player has received during play of the feature game 9. The bonus game token meter 38 in this embodiment is displayed once the player obtains a bonus game token. However, in other embodiments, the bonus game token meter 38 is always present on the lower display area 7*a* and remains blank or shows a zero value until a bonus game token is awarded. Also, in this embodiment the award of the bonus game token is indicated by the appearance of the bonus game token meter 38. However, in other embodiments an image of a bonus game token (either a variation of the bonus games symbol 36 or other image) is shown on the display screen 7 before the bonus game token meter 38 appears on screen.

In this embodiment, the bonus games symbol 36 will continue to repeat appearing in the same symbol position 13 for each subsequent spin of the feature game 9 once it initially appears in one of the free spins of the feature game 9. In other embodiments, the bonus games symbol 36 continues to appear in each subsequent spin of the feature game 9 but change the symbol position 13 in which it appears. In yet another embodiment, the bonus games symbol 36 may only appear randomly during spins of the feature game 9 in any symbol position 13 and need not continually reappear for each subsequent spin of the feature game.

Referring to FIG. 5, where corresponding features have been given the same reference numerals, the fifth free spin has concluded and the counter shows that five free spins remain in the feature game 9. Also, a winning combination of game symbols has appeared on the reels 12*a* to 12*e*, which is shown by visibly highlighting the winning pay line 14 (in other embodiments, the winning pay line also identified by its allocated pay line number). The winning combination comprises three of the same game symbol 10*b* and two of the substitute Whale symbols 10*c* to form a five of a kind. The substitute Whale symbols 10*c* are animated when used in a winning combination. In this embodiment, the animation takes the form of the Whale symbols 10*c* flashing intermittently and FIG. 5 shows both Whale symbols in between flashes. Hence, the symbol positions 13 appear temporarily "blank" between the flashing images. As another bonus games symbol 36 has appeared in the same symbol position 13, the bonus games meter 38 shows that three bonus game tokens have been accumulated (as a bonus games symbol 36 also appeared in the same symbol position 13 for the fourth free spin occurring between the spins shown in FIGS. 4 and 5.

At the conclusion of the tenth and final free spin of the feature game 9, the electronic game controller 4 calculates the number of bonus game tokens that have been accumulated by the player in the feature game, as indicated by the bonus games meter 38. If the number of accumulated bonus game tokens meets a predetermined threshold number, then the player is awarded another feature game 40, called a "bonus game" for ease of reference, with another set of free spins. In other embodiments, the player may be required to make a further bet in order to play the bonus game 40. If the number of accumulated bonus game tokens meets the predetermined threshold number, then the electronic game controller 4 returns the electronic gaming machine 1 back to the base game 8, where the player must make a bet to play the base game. In this embodiment, the predetermined number is one so that any bonus games symbol 36 that appears in the feature game 9 will result in the award of the bonus game 40 as the predetermined threshold number will be met.

Figure 6:
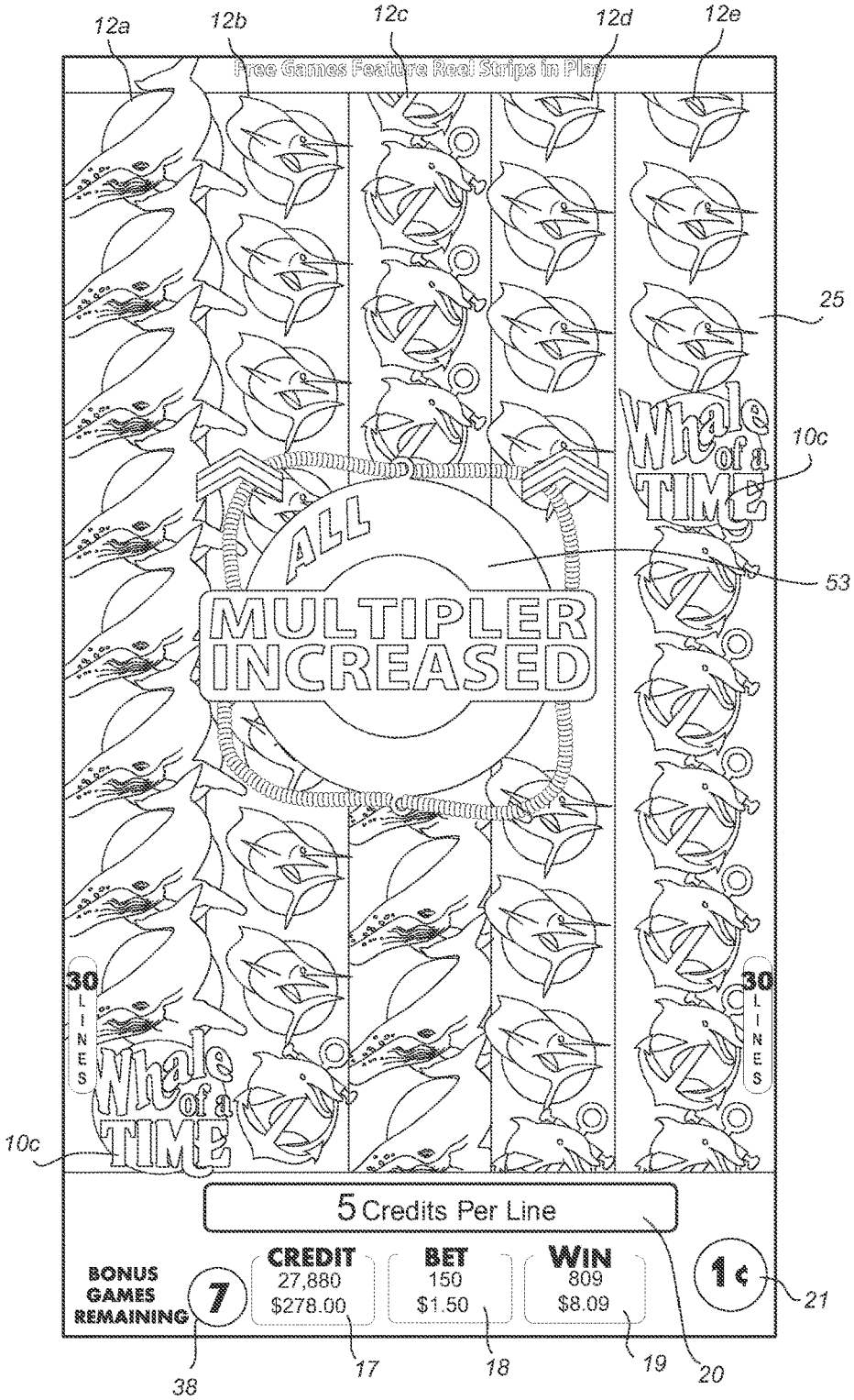
FIG. 6 is a simulated screen shot illustrating a bonus game played on the electronic gaming machine of FIG. 1
Figure 7:
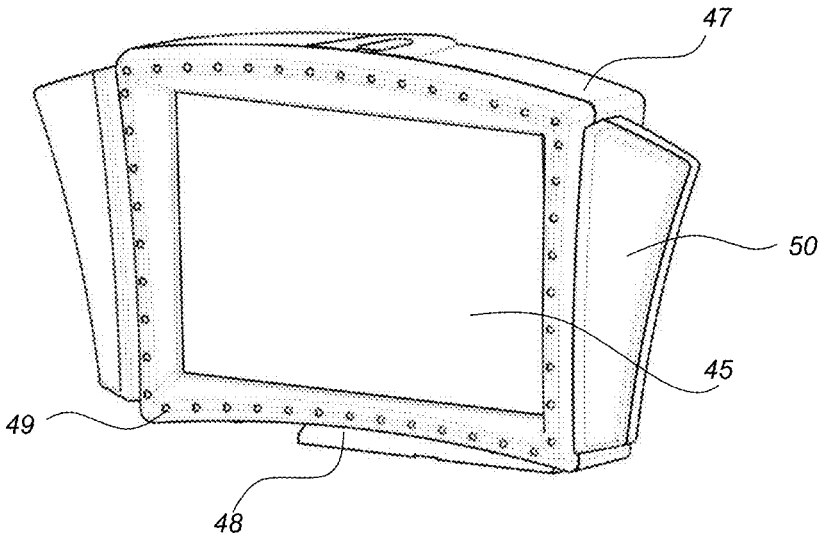
FIG. 7 is a perspective view of a topper that can be mounted to the electronic gaming machine of FIG. 1.
Figure 8:
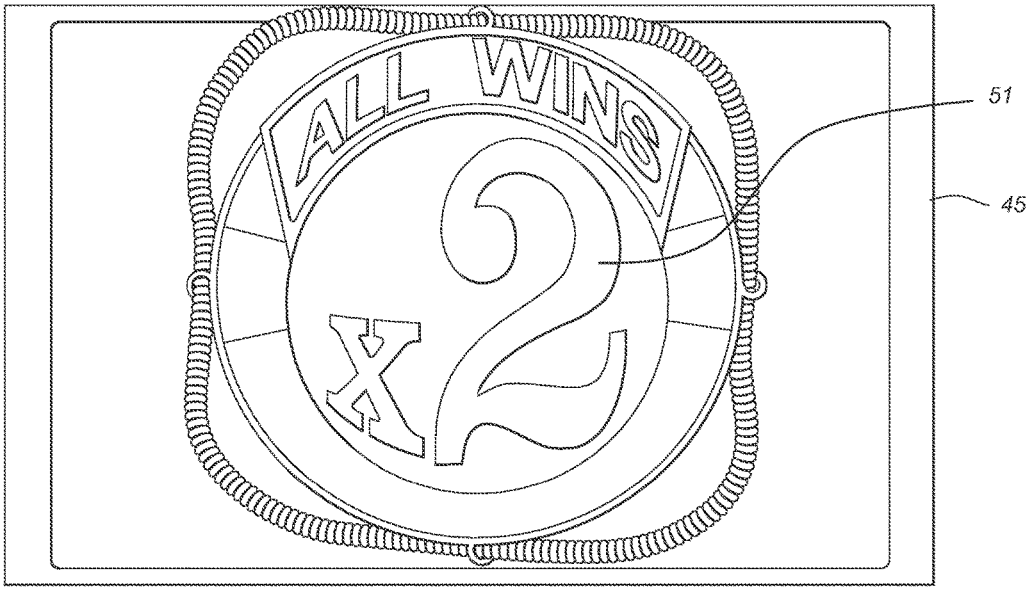
FIGS. 8 to 10 are simulated screen shots of the topper of FIG. 7.

As best shown in FIG. 6, where corresponding features have been given the same reference numerals, the bonus game 40 uses the same array 25, game symbols 10, reels 12*a* to 12*e*, symbol positions 13 and pay lines 14 as the feature game 9. As such, the same winning combinations of game symbols 10 from the base game 8 and feature game 9 will award the same prizes to the player. However, in the bonus game 40, a multiplier is provided that increases the value of any of those prizes. The multiplier is indicated on the display screen 7, such as in the upper display area 7*b*, but in this embodiment is preferably indicated by another separate screen 45 provided by a topper 47 mounted to the top of the electronic gaming machine 1, as best shown in FIG. 7. The topper 47 has a mounting portion 48, lighting devices 49 and audio speakers 50.

In the bonus game 40, ten free spins of the reels 12*a* to 12*e* are awarded to the player. In other embodiments, the number of free spins awarded in the bonus game 40 is related to the number of bonus game tokens accumulated in the feature game 9. In other words, for each bonus game token collected the player is awarded one spin of the bonus game 40. Hence, a single bonus game token accumulated in the feature game 9 will result in only one spin of the bonus game 40, while accumulating seven bonus game tokens in the feature game 9 will grant seven free spins of the bonus game 40. In yet another embodiment, the number of free spins awarded in the bonus game 40 is proportional to the number of bonus game tokens accumulated in the feature game 9. For example, two or three spins of the bonus game 40 may be awarded for each bonus game token accumulated by the player in the feature game 9.

The number of free spins left in the bonus game 40 is indicated by the bonus game token meter 38, which now acts as a counter for the number of free spins remaining in the bonus game. In FIG. 6, the third free spin has concluded and the meter 38 shows that seven free spins remain in the bonus game 40.

The multiplier in the bonus game 40 also changes, up to a maximum value, based upon the number of accumulated bonus game tokens measured by the bonus game token meter 38. In this embodiment, the increase in the value of the multiplier increments in stepwise amount depending on the number of accumulated bonus game tokens so that one bonus token accumulated grants an ×2 multiplier, two bonus tokens accumulated grants an ×3 multiplier and three bonus tokens accumulated grants a maximum multiplier value of 5; i.e. an ×5 multiplier. It will be appreciated that in other embodiments, the multiplier may increase in value based on predetermined thresholds of accumulated bonus game tokens and the maximum value of the multiplier can be set, as desired. For example, in one embodiment, the multiplier may increase in value by one for every three bonus game token accumulated in the feature game 9, up to a maximum value of an ×10 multiplier. Another embodiment has the value of the multiplier is directly related to the number of accumulated bonus game tokens so that one bonus token accumulated grants an ×2 multiplier, two bonus tokens accumulated grants an ×3 multiplier, three bonus tokens accumulated grants an ×4 multiplier, four bonus tokens accumulated grant an ×5 multiplier and so on up a maximum value of an ×8 multiplier. In both these alternative embodiments, there may be more than ten free spins in the bonus game 40 so that the maximum multiplier value can be reached.

Figure 9:
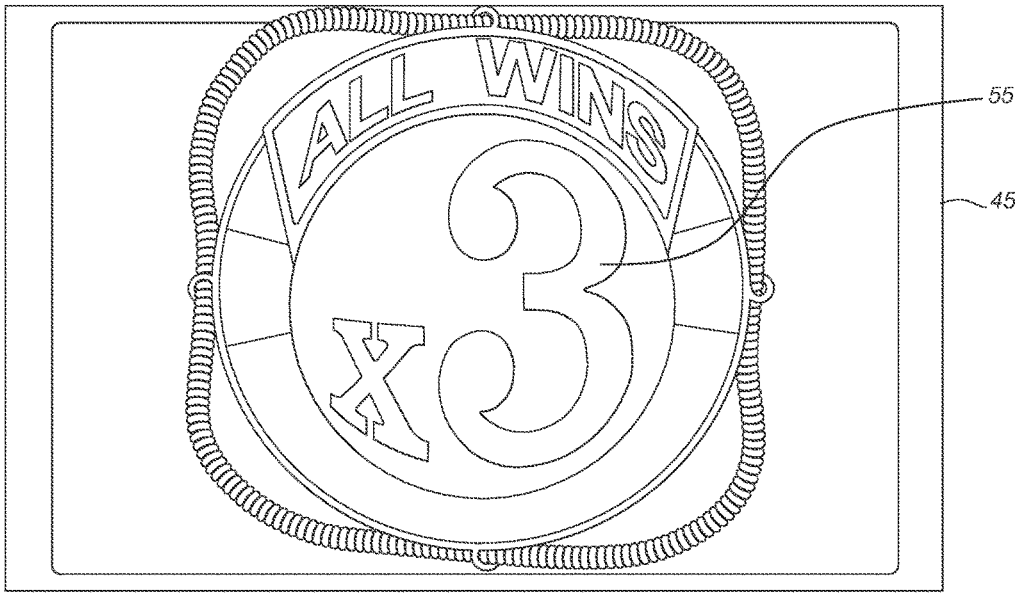
Figure 10:
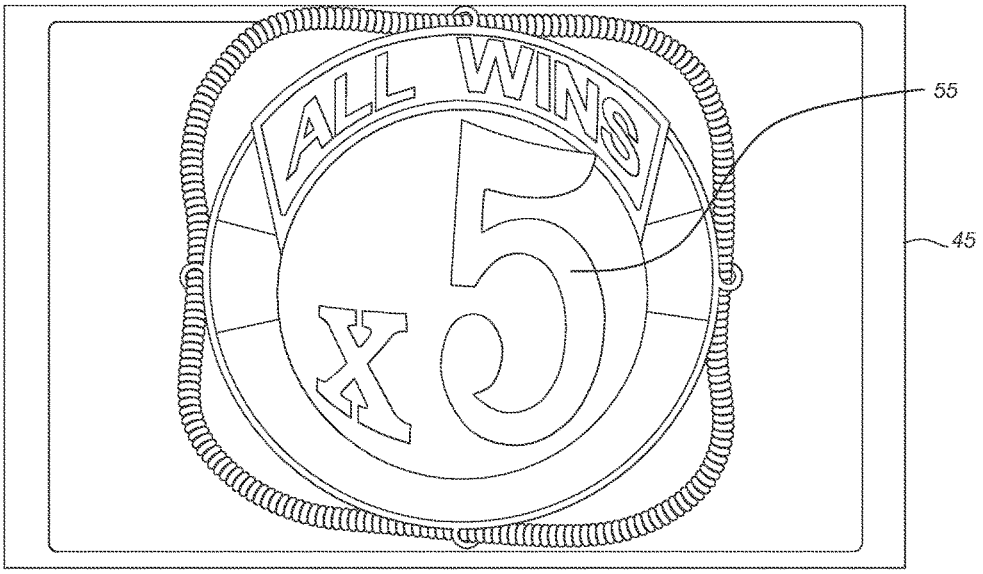

Furthermore, where there is sufficient number of accumulated bonus game tokens to enable multiple changes in the multiplier value, the embodiment increases the value of the multiplier after a set amount of spins. In this case, the multiplier changes after every three spins of the bonus game 40. Thus, the first three spins of the bonus game 40 uses an ×2 multiplier for any prizes awarded in those spins and the screen 45 of the topper 48 visually shows an ×2 multiplier image 51, as best shown in FIG. 7. In FIG. 6, the third free spin has concluded and so the multiplier is changed from an ×2 multiplier to an ×3 multiplier. This is visually indicated to the player via an image 53 appearing over the reels 12 in the display screen 7. The image in the screen 45 of the topper 49 then changes to show an ×3 multiplier image 55, as best shown in FIG. 9. The next three spins then use the ×3 multiplier for any prizes awarded, after which the multiplier changes (if the player as accumulated at least three bonus game tokens) at the conclusion of the sixth free spin to an ×5 multiplier. The image in the screen 45 of the topper 49 then changes to show an ×5 multiplier image 57, as best shown in FIG. 9. The ×5 multiplier is then applied to any prizes awarded for the final four free spins in the bonus game 40. In other embodiments, multiplier value changes after only a single spin, two spins or even four or more spins, as desired for the bonus game 40. The display of the images 51, 55 and 57 assist in visually indicating to the player that the additional return from the multiplier is in effect for those spins of the bonus game 40 as there is no multiplier symbol displayed on the reels 12*a* to 12*e*.

It will be appreciated that the appearance of the bonus games symbol 36, award of the bonus game tokens, the calculation of the accumulated tokens for the bonus game 40, triggering of the bonus game 40, indicating the multiplier in effect and the changing of the multiplier are all accompanied by suitable animation, visual effects and/or aural sounds to indicate each event to the player and heighten the player's excitement and interest.

At the end of the tenth free spin of the bonus game, the electronic game controller 4 returns the electronic gaming machine 1 back to the base game 8, where the player must make a bet to play the base game.

In other embodiments, the bonus games symbol 36 may also appear in the bonus game 40, resulting in the retriggering of the bonus game. In this case, the bonus game token meter 38 may either increase to keep adding to the number of spins remaining or there would be a separate counter for the remaining spins in the bonus game 40 and the bonus game token meter 38 would be used solely to indicate bonus game tokens accumulated during play of the bonus game 40. In the latter case, at the conclusion of the bonus game 40, the electronic game controller 4 then calculates whether the number of bonus game tokens that have been accumulated by the player in the bonus game 40 meets the predetermined threshold number and if so, then the player is awarded another round of the bonus game 40. If the number of bonus game tokens that have been accumulated by the player in the bonus game 40 does not meet the predetermined threshold number, then the electronic game controller 4 returns the electronic gaming machine 1 back to the base game 8, where the player must make a bet to play the base game.

Thus, by providing a bonus game and a multiplier for prizes won in the bonus game that are linked to the accumulation of tokens in the feature game, the player has a greater opportunity to obtain winning combinations of game symbols for prizes of higher value, particularly as the multiplier changes to higher values. This increases the excitement in the player playing the base game 8 on the electronic gaming machine 1 and encourages the player to continue playing the same electronic gaming machine.

In other embodiments of the invention, the substitute Whale symbol 10*c* acts as a special symbol for awarding the bonus game tokens in the feature game 9 and/or bonus game 40. It will also be appreciated that in other embodiments, a scatter symbol could be used as the special symbol. In yet further embodiments, the functions of the Whale symbol 10*c* are divided so that there is a separate trigger symbol (which could be a scatter symbol) for triggering the feature game 9, a separate substitute symbol used across all the games and one or more special symbols that result in the award of the bonus game tokens.

In other embodiments, the frequency (and thus appearance) of the feature game trigger symbol and/or special symbol may depend on the bet option selected by the player. For example, selecting a bet option of 10 credits may make the Whale symbol 10*c* and/or the bonus games symbol have a higher frequency of appearing on the reels 12*a* to 12*e* during play of the base game 8 and/or feature game 9, in order to increase the chance of triggering the feature game 9 and/or bonus game 40 during game play.

The jackpots (as described by message boxes 23*a* to 23*d*) offered by the electronic gaming machine 1 may include progressive jackpots, fixed jackpots, mystery jackpots and symbol driven jackpots. Also, other bonus prizes can be awarded by the electronic gaming machine 1. The jackpots are not necessarily limited to the base game 8, but may be offered in the feature game 9 only, bonus game 40 only or any combination of the base, feature and bonus games.

A progressive jackpot prize takes a portion of each bet (typically a set percentage of each bet) made on the electronic gaming machine and thus the amount of the progressive jackpot incrementally increases as more bets are made on the electronic gaming machine 1. The progressive jackpot is typically awarded when a winning game combination associated with the jackpot occurs in the game played on the electronic gaming machine. In many cases, progressive jackpots are associated with the least probable winning combination and are commonly the highest paying award of the electronic gaming machine. In other cases, a separate trigger event can be used to award the progressive jackpot prize, such as a special jackpot symbol, a trigger event internally generated by the electronic game controller. Alternatively, or additionally, once a certain threshold is met, either a certain amount that has been bet on the electronic gaming machine or the incremented amount of the progressive jackpot, a trigger event is activated in the electronic gaming machine to pay out the progressive jackpot prize. Progressive jackpot prizes also tend to be shared amongst multiple electronic gaming machines so as to increase the amount of the progressive jackpot prize and hence increase player interest in playing one of the electronic gaming machines. In some electronic gaming machines, more than one jackpot or progressive jackpot is offered by the electronic gaming machine or electronic gaming machines linked together.

The jackpot or bonus prizes may also be mystery jackpots rather than symbol driven jackpots. That is, none of the symbols in the game trigger the jackpot; hence the trigger event is a "mystery". By way of comparison, a standard jackpot is typically symbol driven in that a particular combination of symbols must occur in the game to trigger the standard jackpot.

The trigger event for the mystery jackpot can be one randomly generated by the electronic game controller 4 for each play of the base game 8, feature game 9 and/or bonus game 40. One way to implement the random determination of the trigger event is for the electronic game controller 4 to internally generate a random number and check if it is a predetermined number or within a predetermined range of numbers that will initiate the appearance of the trigger symbols. For example, the predetermined range of numbers could be the range of numbers between 1 and 10 and the electronic game controller 4 internally generates a random number between 1 and 100. If the generated number is any one of numbers 1 to 10, then this results in the electronic game controller 4 causing the trigger event to occur and award the progressive jackpot prize. It will be appreciated that this manner of determining the trigger event may also be used to determine whether the feature game 9 is triggered in the base game 8.

Progressive jackpots can be confined to the electronic gaming machine 1 as so called "standalone" progressive jackpots. Alternatively, the jackpot is a wide area or an in-house linked progressive jackpot prize. In other embodiments, one or more the progressive jackpot prizes are configured to be part of a wide area or in-house linked progressive jackpot prize. In other words, the progressive jackpot prizes can be awarded on a group of networked gaming machines in a specified area or a group of specified electronic gaming machines that are linked together for jackpot purposes (usually via a central jackpot controller). The jackpot prizes can also be shared with any other games offered on the same electronic gaming machine 1 (as in multi-game gaming machines).

During play of the base game 8, feature game 9 and/or bonus game 40, the electronic game controller will determine whether a trigger event for any of the jackpots has occurred, as described above. In response to the occurrence of the jackpot trigger event(s), the electronic game controller 4 transmits a signal to the video screen 7 to cause the jackpot(s) associated with the jackpot trigger event(s) to be awarded to the player. After the jackpot(s) are awarded, their values are reset and game play of the electronic gaming machine 1 continues as before. The values of the jackpots that have been won can be reset either to a predetermined start value or simply increment upwardly from zero where the won jackpot is a progressive jackpot. In addition, contributions of portions of the bet made to play the game are only made for the jackpots that are active. In this way, the player's bets do not contribute towards jackpots that the player cannot win.

In other embodiments, the in-game trigger event is determined at the end or during the play of the game; i.e. at the end or during a spin of the reels 12. In some embodiments, the in-game trigger event occurs in a preceding play of the game so that the jackpot or other result of the in-game trigger event takes place in a subsequent play of said game, typically the next play of the game after said preceding play but could include a later successive play of the game.

In other embodiments, the electronic gaming machine 1 also offers the player the opportunity to play in community games against other players in so-called tournament games, or even in player versus player games. This is typically implemented by electronically linking several electronic gaming machines 1 in a group within a gaming venue. The player versus player or tournament game can be played simultaneously by the players or can be staggered, with some players playing at one time and some players playing at another time in the same game. In this situation, the player versus player or tournament game comprises the award of an additional bonus prize in addition to the jackpot prizes in said selected available jackpot set.

It will be appreciated that in other embodiments, game enhancing elements can be awarded in the feature game 9 or bonus game 40 in addition or as an alternative to the enhanced prizes awarded based on winning combinations of game symbols. The award of game enhancing elements can be done by way of a sixth reel or the appearance of game enhancing symbols in the reels 12*a* to 12*e*. A variety of game enhancing elements can be awarded by the game enhancing symbols, including:

i) symbols that award a predetermined number of free plays of said game, such as 8, 10 or 15 free spins or games;
ii) win multiplier symbols that multiply the amount of any win from one of said predetermined winning combinations;
iii) "wild" symbols that cause the display of substitute symbols in randomly selected symbol positions;
iv) bonus symbols that awards a bonus prize, either as a monetary amount or as a bonus credit;
v) wild multiplier symbols that cause the display of substitute symbols on the array 25 and multiplies the amount of any win from one of said predetermined winning combinations;
vi) bonus wild symbols that cause the display of substitute symbols on the array 25 and awards a bonus prize;
vii) symbols that cause the award of additional free plays of said game;
viii) symbols that cause one or more of said symbol positions to be held static (typically one or more reels 12*a* to 12*e*) and display substitute symbols on the array 25;
ix) symbols that cause the same game symbol to be stacked in a group of symbol positions, typically the group being one or more reels 12*a* to 12*e;*
x) symbols that cause the display of new game symbols on the array 25;
xi) "reveal" symbols that cause a game symbol to reveal another game symbol;
xii) "replacement" symbols that cause one or more game symbols to be replaced by other game symbols in the array 25;
xiii) bonus prize of 5×bet, 10×bet or 25×bet (the total amount of the bet or credits bet per pay line);
xiv) all royal card symbols change to wilds (substitute symbols) on reels 12*b*, 12*c* and 12*d* (usually called reels 2, 3 and 4, respectively) of the array 25;
xv) all picture symbols change to wilds on reels 2, 3 and 4 of the array 25;
xvi) all symbols on reels 2 and 4 of the array 25 change to wild symbols; and
xvii) all symbols on reels 12*a* and 12*e* (usually called reels 1 and 5, respectively) of the array 25 change to wild symbols.

These game enhancing symbols do not modify the function or value of the game symbols 10 that appear on the array 25, but instead confer bonus prizes, free games or change existing game symbols for other game symbols (such as replacing picture, royal card or symbols belonging to a reel with wild/substitute symbols). Where the function of game symbols 10 have been changed or the game symbols 10 are replaced, then this modification can take effect with the next play of the game instead of applying to the result of the spun array 25. In another embodiment, the game enhancing symbols may indicate the duration in which its game enhancing element is applied, such as a predetermined number of spins or a predetermined time period.

While the same game format is essentially used across the base game 8, feature game 9 and bonus game 40, it will be appreciated that the game format may vary across the base, feature and bonus games, as well as between base games where more than one game is offered by the same electronic gaming machine 1. For example, one of the base, feature and bonus games may be a wheel-type game or a four reel game and another of the base, feature and bonus games may be a standard five reel game. Similarly, the base, feature and bonus games may each have different game symbols, game rules and pay tables that are unique to each game.

While one embodiment of the invention has been described in relation to a base game 8, a feature game 9 and bonus game 40, it will be appreciated that the invention could include one or more additional feature and/or bonus games that are triggered by specific trigger symbols appearing in the feature game 9 and/or bonus game 40. Also, the additional feature or bonus games may also have trigger symbols that trigger further feature or bonus games in a cascading fashion. These additional and further feature or bonus games could have the same game play elements as the feature game 9, bonus game 40 or be different feature or bonus games entirely. The ability to accumulate bonus game tokens may be available in these additional feature or bonus games or only some of these additional games, with or without requiring a further bet to be made.

Furthermore, the embodiments of the invention have been described as providing a standard 5×3 set of reels 12 for the base game 8. However, it will be appreciated that in other embodiments, the size and shape of the reels 12 may vary for the base game 8, the feature game 9 and/or bonus game 40. For example, the arrays 11 and 25 could take any number of different shapes, such as triangular, circular, square, hexagonal, hemi-spherical or other non-rectangular or polygonal shapes. In another example, where the array is circular, the symbol positions 13 can take the form of pie-shaped slices or wedges. Alternatively, the arrays 11 and 25 could have an unequal number of rows and/or columns. For example, the reels 12*a*, 12*b* could have three rows, but the reels 12*c* to 12*e* could have four rows.

In other embodiments, the base game 8, the feature game 9 and bonus game 40 need not be displayed on a single video screen 7. Instead, they may be displayed on separate video screens, with the lower display area 7*a* appearing in a lower video screen and the upper display area 7*b* on an upper video screen. Also, the order can be reversed, with the base game 8 and/or feature game 9 appearing on an upper video screen or upper display area 7*b* of a single video display screen 7 and the information usually shown on the upper display area 7*b* appearing on a lower video screen or lower display area 7*a* of a single video display screen.

In another embodiment, the video screen 7 is a touch screen for use in addition to the player-actuatable buttons 6 so as to enable the player to select the bet level (such as bet denominations or bet per pay line 14) as well as other various features, such as making monetary bets for the game, initiating play of any base and feature games played and responding to any messages or requests issued on the electronic gaming machine 1 by the electronic game controller 4. In this case, the player may control when the reels 12 start spinning and stop spinning, either individually or collectively, by simply touching the reels 12. Control over spinning of the reels 12 can also be implemented through the buttons 6 on the console 3. This increases player interaction and provide the player with an opportunity to guess when a particular game symbol 10 may appear in the reels 12.

Figure 11:
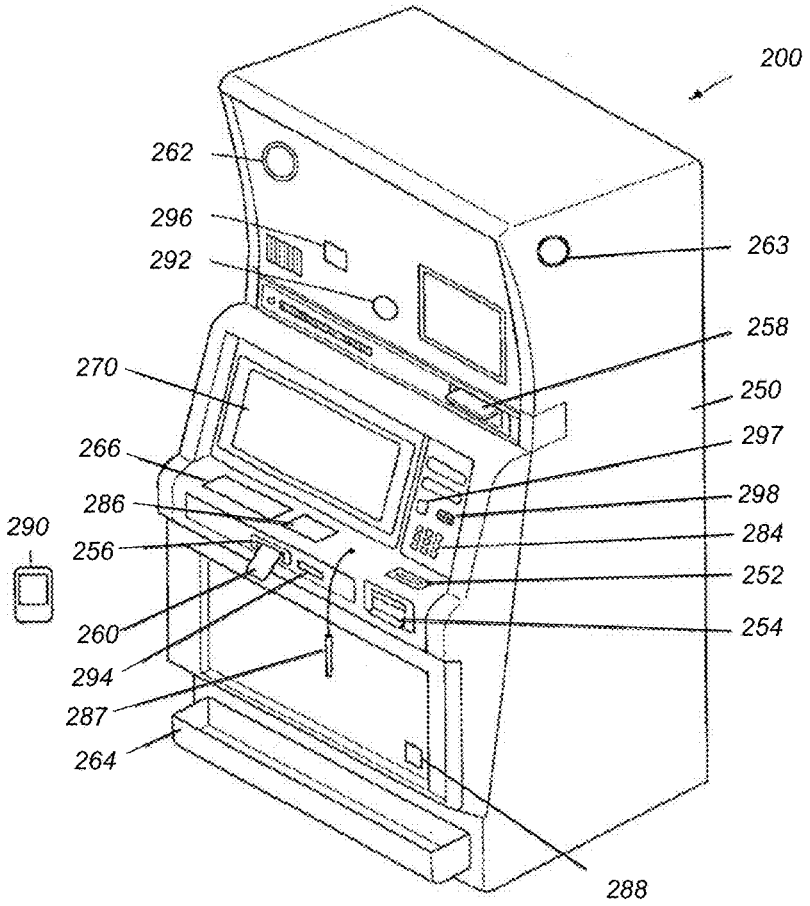
FIG. 11 is a perspective view of an electronic gaming machine according to another embodiment of the invention.

Referring to FIG. 11, another embodiment of the invention is shown in the form of an electronic gaming machine 200. The electronic gaming machine 200 may include a housing or cabinet 250 and one or more value transfer mechanisms or devices, which may include a coin slot or acceptor 252, a paper currency or bill acceptor 254, a ticket reader/printer 256 and a card reader 258, which may be used to input value to the electronic gaming machine 200. A value transfer device may include any device that can accept value from a player. The topper 47 of FIGS. 7 to 10 may be mounted to the top of the electronic gaming machine 200.

If provided on the electronic gaming machine 200, the ticket reader/printer 256 may be used to read and/or print or otherwise encode ticket vouchers 260. The ticket vouchers 260 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 260 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 260 could be printed with an optically readable material such as ink, or data on the ticket vouchers 260 could be magnetically encoded. The ticket reader/printer 256 may be provided with the ability to both read and print ticket vouchers 260, or it may be provided with the ability to only read or only print or encode ticket vouchers 260. In the latter case, for example, some of the electronic gaming machines 200 may have ticket printers 256 that may be used to print ticket vouchers 260, which could then be used by a player in other electronic gaming machines 200 that have ticket readers 256.

If provided, the card reader 258 may include any type of card reading device, such as a magnetic card reader or an optical card reader, and may be used to read data from a card offered by a player, such as a credit card or a player tracking card. If provided for player tracking purposes, the card reader 258 may be used to read data from, and/or write data to, player tracking cards that are capable of storing data representing the identity of a player, the identity of a casino, the player's gaming habits, etc.

The electronic gaming machine 200 may include one or more audio speakers 262, a coin payout tray 264, an input control panel 266, and a colour video display unit 270 for displaying images relating to the game or games provided by the electronic gaming machine 200. The audio speakers 262 may generate audio representing sounds such as the noise of spinning reels, a dealer's voice, music, announcements or any other audio related to a game. The input control panel 266 may be provided with a plurality of pushbuttons or touch-sensitive areas that may be pressed by a player to select games, make wagers, make gaming decisions, etc.

Figure 12:
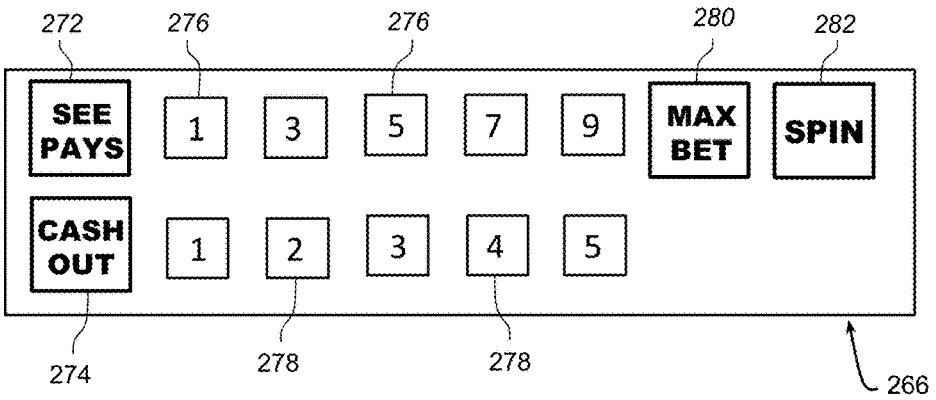
FIG. 12 is a schematic drawing of a control panel for the electronic gaming machine of FIG. 11.

FIG. 12 illustrates one possible embodiment of the control panel 266, which may be used where the electronic gaming machine 200 having a plurality of reels. The control panel 266 may include a "See Pays" button 272 that, when activated, causes the display unit 270 to generate one or more display screens showing the odds or payout information for the game or games provided by the electronic gaming machine 200. As used herein, the term "button" is intended to encompass any device that allows a player to make an input, such as an input device that must be depressed to make an input selection or a display area that a player may simply touch. The control panel 266 may include a "Cash Out" button 274 that may be activated when a player decides to terminate play on the electronic gaming machine 200, in which case the electronic gaming machine 200 may return value to the player, such as by returning a number of coins to the player via the payout tray 264.

The control panel 266 may be provided with a plurality of selection buttons 276, each of which allows the player to select a different number of pay lines prior to spinning the reels. For example, five buttons 276 may be provided, each of which may allow a player to select one, three, five, seven or nine pay lines.

The control panel 266 may also be provided with a plurality of selection buttons 78 each of which allows a player to specify a wager amount for each pay line selected. For example, the electronic gaming machine 200 may be provided with five selection buttons 78, each of which may allow a player to select 1¢, 2¢, 5¢, 10¢ and 20¢, to wager for each pay line selected. In that case, if a player were to activate one of the buttons 276 to select five pay lines and then activate one of the buttons 278 to select 5¢ per pay line to be wagered or bet, the total wager would be $0.25.

The control panel 266 may include a "Max Bet" button 280 to allow a player to make the maximum wager allowable for a game. In the above example, where up to nine pay lines were provided and up to 20¢ could be wagered for each pay line selected, the maximum wager would be $1.80 The control panel 266 may include a spin button 282 to allow the player to initiate spinning of the reels after a bet has been made.

In FIG. 12, a rectangle is shown around the buttons 272, 274, 276, 278, 280, 282. It should be understood that the rectangle simply designates, for ease of reference, an area in which the buttons 272, 274, 276, 278, 280, 282 may be located. Consequently, the term "control panel" should not be construed to imply that a panel or plate separate from the housing 250 of the electronic gaming machine 200 is required, and the term "control panel" may encompass a plurality or grouping of player activatable buttons.

Although one possible control panel 266 is described above, it should be understood that different buttons could be utilized in the control panel 266, and that the particular buttons used may depend on the game or games that could be played on the electronic gaming machine 200. Although the control panel 266 is shown to be separate from the display unit 270, it should be understood that the control panel 266 could be generated by the display unit 270. In that case, each of the buttons of the control panel 266 could be a coloured area generated by the display unit 270, and some type of mechanism may be associated with the display unit 270 to detect when each of the buttons was touched, such as a touch-sensitive screen.

As noted above, the electronic gaming machine 200 may include a mechanism by which the electronic gaming machine 200 may determine the identity of the player. In particular, the card reader 258 may be used to read a card that carries an identification code that may be uniquely associated with the player so that the gaming unit can differentiate that player from all other players, or so that the gaming unit can differentiate that player as a member of a group of players from all player not a member of the group of players. The electronic gaming machine 200 may also include equipment, such as a keypad 284, an input pad 286 (with optional stylus 287), a port (or antenna) 288 adapted to communicate via a wired or wireless link (infrared or radio frequency link, for example) to a mobile electronic device 290 (such as a personal digital assistant, smart phone or tablet), a camera 292, a scanner 294, a retinal (or iris) scanner 296, fingerprint scanner 297, and/or a microphone 298. The electronic gaming machine 200 may include any one of the devices 258, 284, 286, 288, 290, 292, 294, 296, 297, 298, or the electronic gaming machine 200 may include a combination of some or all of the devices 258, 284, 286, 287, 288, 290, 292, 294, 296, 297, 298.

In operation, a player may identify him or herself to the electronic gaming machine 200 by entering a unique numeric or alpha-numeric code using the key pad 284, for example. Alternatively, the player may use his or her finger or the stylus 287 to sign his or her signature on the input pad 286. As a further alternative, the player may sign his or her signature on the mobile electronic device 290, which signature is then converted to electronic data, and the data is then transferred via the port/antenna 288 to the electronic gaming machine 200. As yet another alternative, the player may sign his or her signature on a piece of paper that is then photographed using the camera 292 or scanned using the scanner 294 (or the bill acceptor 254) to convert the signature into electronic data. As an additional alternative, the player may place one of his or her fingers or his or her hand on the scanner 297, and the scanner 297 may generate an electronic data representation of the fingerprint on one or more of the player's fingers or an electronic data representation of the pattern of the entire hand. Alternatively, the camera 292 may be used to take a picture (live or still) of the player, the picture then being converted into electronic data. As a still further alternative, the player may place his or her eye up to the retinal (or iris) scanner 296, and the retinal (or iris) scanner 296 may generate an electronic data representation corresponding to the pattern of the retina (or iris) of the player. As yet another alternative, the player may speak into the microphone 298, and characteristics of the spoken words (or voiceprint) may be converted into an electronic data representation.

Figure 13:
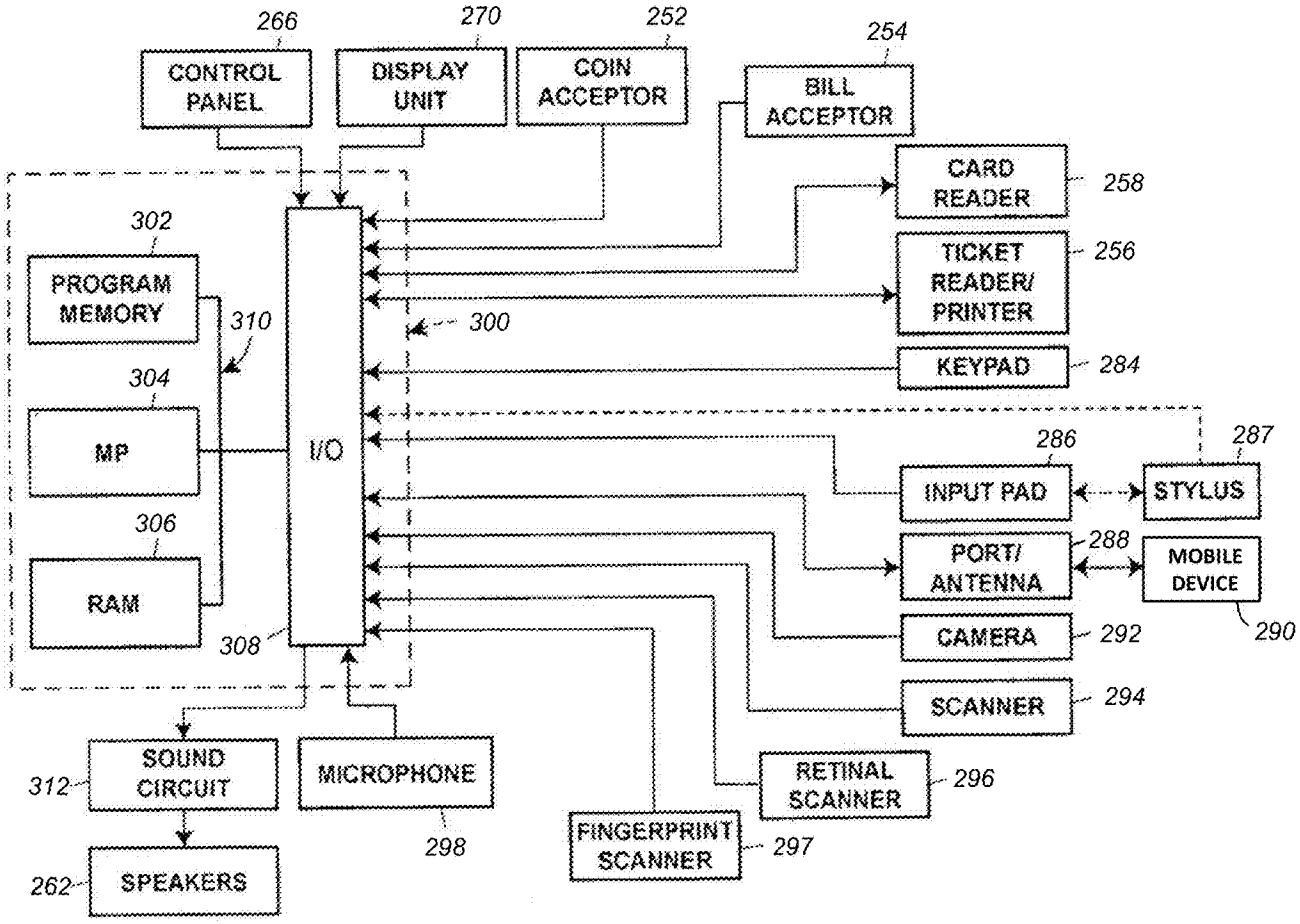
FIG. 13 is a block diagram of the electronic components of the electronic gaming machine of FIG. 11.

FIG. 13 is a block diagram of a number of components that may be incorporated in the electronic gaming machine 200. Referring to FIG. 12, the electronic gaming machine 200 may include a controller 300 that may comprise a program memory 302, a microcontroller or microprocessor (MP) 304, a random-access memory (RAM) 306 and an input/output (I/O) circuit 308, all of which may be interconnected via an address/data bus 310. It should be appreciated that although only one microprocessor 304 is shown, the controller 300 may include multiple microprocessors 304. Similarly, the memory of the controller 300 may include multiple RAMs 306 and multiple program memories 302. Although the I/O circuit 108 is shown as a single block, it should be appreciated that the I/O circuit 308 may include a number of different types of I/O circuits. The RAM(s) 304 and program memories 302 may be implemented as semiconductor memories, magnetically readable memories, and/or optically readable memories, for example.

FIG. 13 illustrates that the coin acceptor 252, the bill acceptor 254, the ticket reader/printer 256, the card reader 258, the control panel 266, the display unit 270, the keypad 284, the input pad 286 (and optionally the stylus 287), the port/antenna 288, the digital camera 292, the scanner 294, the retinal scanner 296, the fingerprint scanner 297 and the microphone 298 may be operatively coupled to the I/O circuit 308, each of those components being so coupled by either a unidirectional or bidirectional, single-line or multiple-line data link, which may depend on the design of the component that is used. The speaker(s) 262 may be operatively coupled to a sound circuit 312, that may comprise a voice- and sound-synthesis circuit or that may comprise a driver circuit. The sound-generating circuit 312 may be coupled to the I/O circuit 308.

As shown in FIG. 13, the components 252, 254, 256, 258, 266, 270, 284, 286, 287, 288, 292, 294, 296, 297, 298, 312 may be connected to the I/O circuit 308 via a respective direct line or conductor. Different connection schemes could be used. For example, one or more of the components shown in FIG. 12 may be connected to the I/O circuit 308 via a common bus or other data link that is shared by a number of components. Furthermore, some of the components may be directly connected to the microprocessor 304 without passing through the I/O circuit 308.

It will be appreciated that while the preferred embodiments have been described in relation to an industry standard electronic gaming machine, the invention can be readily applied to other types of electronic gaming machines, including a personal computer (standing alone or connected to a communications network, LAN or WAN), mobile electronic devices (such as handheld or portable electronic devices like tablets and smart phones) and other electronic devices capable of displaying a game. In the case of mobile electronic device, in one arrangement it may permit the player to make bets using "virtual" credits that represent a monetary value, but do not require the player to make a monetary transaction. Instead, the invention may provide a tiered access to the various features of the game so that the player can make relatively small payments to access particular features of the game or obtain additional benefits during game play. An alternative arrangement would require the player to purchase virtual credits or tokens via an interface on the mobile electronic device or an online interface accessible by the mobile electronic device. Similarly, either of the above described arrangements can be applied where the invention is implemented on a personal computer (PC) connected to the internet (wirelessly or not). In one example of the implementation, the PC would access an online casino over the internet to play the game of the invention or the game of the invention would be part of a social networking website. It is also contemplated that the player could also make regular payments to subscribe to continue playing the game on the mobile electronic device, PC or other electronic device.

In an alternative embodiment, the electronic gaming machine also provides an option for the player to play with either credits based on a monetary amount or virtual credits as discussed above. This can be implemented by way of a selection menu prior to playing the selected game or by providing a suitable menu button on screen during play of the selected game.

In another aspect, the invention includes a computer programme configured to perform the invention. In this way the invention can be implemented in various ways on an electronic gaming machine. In a further aspect, the invention includes a gaming system configured comprising a central processing unit (such as a computer or computational processor) configured for communication with an electronic gaming machine to perform the invention. In a yet another aspect, the invention includes a non-transitory computer readable or carrier medium carrying computer executable code that, when executed on a central processing unit configured for communication with an electronic gaming machine, causes said central processing unit to perform the invention. In this case, the non-transitory carrier medium includes an external hard drive, a memory device, including a memory card, smart card, a radio frequency identification (RFID) device, USB key, magnetic card or other electronic storage device.

It will further be appreciated that any of the features in the preferred embodiments of the invention can be combined together and are not necessarily applied in isolation from each other. For example, the feature of the player being able to selectively starting or stopping spinning of the reels 12 and the feature of providing separate video screens for the lower display area 7*a* and upper display area 7*b* can be combined into a single electronic gaming machine 1. Similar combinations of two or more features from the above described embodiments or embodiments of the invention can be readily made by one skilled in the art.

By providing a bonus game that is activated by accumulation of tokens obtained in another game and linking the number of tokens with one or more multipliers that are applied to prizes awarded in the bonus game, the player's anticipation and excitement is heightened as he or she knows that additional games that can be won with prizes enhanced in value by a multiplier once the necessary number of tokens have been collected to reach the threshold token value. Moreover, there is a greater variety of game play provided by the electronic gaming machine that is not ordinarily provided by conventional gaming machines. Thus, the invention retains the player's interest and so the player is likely to continue playing the same electronic gaming machine. The invention also adds greater value to a player in terms of the probability of winning a prize relative to the amount bet or wagered, especially compared to a conventional electronic gaming machine that only has one set of reels and a single feature game. All these advantages of the invention result in the player being more likely to retain interest in continuing to play the same electronic gaming machine. Furthermore, since the electronic game controller controls operation of the electronic gaming machine, the invention can be readily implemented to existing gaming machines and other gaming systems. In all these respects, the invention represents a practical and commercially significant improvement over the prior art.

Although the invention has been described with reference to specific examples, it will be appreciated by those skilled in the art that the invention may be embodied in many other forms.

The invention claimed is:

1. An electronic gaming machine comprising:

a display for displaying game symbols for playing a first game, said first game comprising randomly displaying randomly selected game symbols in a first array, wherein the display of predetermined winning combinations of said game symbols results in the award of prizes to a player;

an electronic game controller for controlling the display of said game symbols on said display; and a value transfer mechanism for receiving value from a player to make a bet and initiate play of said first game on said display, said value transfer mechanism being in electronic communication with said electronic game controller;

wherein said electronic game controller in response to said player making a bet via said value transfer mechanism commences play of said first game by randomly selecting game symbols and transmitting a signal to said display to display said randomly selected game symbols;

wherein said electronic game controller in response to a first feature game trigger event in the first game commences play of a first feature game by randomly selecting game symbols without requiring any bet to be made by the player and transmitting a signal to said display to display said randomly selected game symbols in a second array that has a greater number of symbol positions than the first array;

wherein said first feature game comprises the appearance of one or more special symbols that results in the award of one or more tokens to said player, said tokens being associated with at least one token value;

wherein said electronic game controller determines an accumulated token value from the token values of the tokens awarded to said player;

wherein, in response to a second feature trigger event, said electronic game controller causes said display to display game symbols for playing a second feature game without requiring any bet to be made by the player, said second feature game comprising predetermined winning combinations of randomly selected game symbols awarding prizes to said player and said electronic game controller transmitting a signal to said display to display said randomly selected game symbols in said second array; and wherein a multiplier is applied to increase the value of any prizes awarded in said second feature game, the value of said multiplier being associated with said accumulated token value.

2. The electronic gaming machine of claim 1, wherein said multiplier varies from an initial multiplier value up to a maximum multiplier value between two or more plays of said second feature game.

3. The electronic gaming machine of claim 2, wherein said multiplier incrementally increases by one from said initial multiplier value up to said maximum multiplier value.

4. The electronic gaming machine of claim 2, wherein said multiplier increases by stepwise amounts from said initial multiplier value up to said maximum multiplier value.

5. The electronic gaming machine of claim 2, wherein said multiplier changes in value after a predetermined number of plays of said second feature game.

6. The electronic gaming machine of claim 5, wherein said predetermined number of plays of said second feature game is one.

7. The electronic gaming machine of claim 5, wherein said predetermined number of plays of said second feature game is three.

8. The electronic gaming machine of claim 2, wherein said maximum multiplier value is associated with said accumulated token value.

9. The electronic gaming machine of claim 8, wherein said maximum multiplier value increases with an increase in said accumulated token value.

10. The electronic gaming machine of claim 9, wherein said maximum multiplier value is limited to a capped value.

11. The electronic gaming machine of claim 1, wherein said multiplier is shown in real time on said display during play of said second feature game.

12. The electronic gaming machine of claim 1, wherein an in-game message is displayed on said display advising said multiplier in effect during said second feature game.

13. The electronic gaming machine of claim 1, wherein said second feature trigger event comprises said accumulated token value being equal to or in excess of a predetermined number.

14. The electronic gaming machine of claim 13, wherein said electronic game controller determines whether said second feature trigger event has occurred at the end of said first feature game.

15. The electronic gaming machine of claim 1, wherein said tokens awarded to said player are shown on said display.

16. The electronic gaming machine of claim 15, wherein said awarded tokens are displayed in a meter in real time on said display.

17. The electronic gaming machine of claim 1, wherein said token values associated with said awarded tokens are shown on said display.

18. The electronic gaming machine of claim 17, wherein said token values associated with said awarded tokens are displayed in a meter in real time on said display.

19. The electronic gaming machine of claim 1, wherein said accumulated token value is shown on said display.

20. The electronic gaming machine of claim 19, wherein said accumulated token value is displayed in a meter in real time on said display.

21. An electronic gaming machine comprising:

a display for displaying game symbols for playing a first game, said first game comprising randomly displaying randomly selected game symbols, wherein the display of predetermined winning combinations of said game symbols results in the award of prizes to a player;

an electronic game controller for controlling the display of said game symbols on said display; and a value transfer mechanism for receiving value from a player to make a bet and initiate play of said first game on said display, said value transfer mechanism being in electronic communication with said electronic game controller;

wherein said electronic game controller in response to said player making a bet via said value transfer mechanism commences play of said first game by randomly selecting game symbols and transmitting a signal to said display to display said randomly selected game symbols;

wherein said first game comprises the appearance of one or more special symbols that results in the award of one or more tokens to said player, said tokens being associated with at least one token value;

wherein said electronic game controller determines an accumulated token value from the token values of the tokens awarded to said player;

wherein, in response to a trigger event, said electronic game controller causes said display to display game symbols for playing a second game, said second game comprising predetermined winning combinations of randomly selected game symbols awarding prizes to said player; and wherein a multiplier is applied to increase the value of any prizes awarded in said second game, the value of said multiplier being associated with said accumulated token value wherein the appearance of said special symbol in a designated symbol position in a play of said first game results in said special symbol reappearing in said designated symbol position for subsequent plays of said first game and said second game.

22. An electronic gaming machine comprising:

a display for displaying game symbols for playing a first game, said first game comprising randomly displaying randomly selected game symbols, wherein the display of predetermined winning combinations of said game symbols results in the award of prizes to a player;

an electronic game controller for controlling the display of said game symbols on said display; and a value transfer mechanism for receiving value from a player to make a bet and initiate play of said first game on said display, said value transfer mechanism being in electronic communication with said electronic game controller;

wherein said electronic game controller in response to said player making a bet via said value transfer mechanism commences play of said first game by randomly selecting game symbols and transmitting a signal to said display to display said randomly selected game symbols;

wherein said first game comprises the appearance of one or more special symbols that results in the award of one or more tokens to said player, said tokens being associated with at least one token value;

wherein said electronic game controller determines an accumulated token value from the token values of the tokens awarded to said player;

wherein, in response to a trigger event, said electronic game controller causes said display to display game symbols for playing a second game, said second game comprising predetermined winning combinations of randomly selected game symbols awarding prizes to said player; and wherein a multiplier is applied to increase the value of any prizes awarded in said second game, the value of said multiplier being associated with said accumulated token value, wherein the appearance of said special symbol in a designated symbol position in a play of said second game results in said special symbol reappearing in said designated symbol position for subsequent plays of said second game.

23. The electronic gaming machine of claim 1, wherein said multiplier is not associated with any of said game symbols in said first feature game.

24. The electronic gaming machine of claim 1, wherein said multiplier is not associated with any of said game symbols in said second feature game.

* * * * *